US012654965B2

(12) United States Patent
Furusawa

(10) Patent No.: US 12,654,965 B2
(45) Date of Patent: Jun. 16, 2026

(54) MEDIUM FEEDING APPARATUS, RECORDING APPARATUS, AND CONTROL METHOD FOR RECORDING APPARATUS

(71) Applicant: SEIKO EPSON CORPORATION, Tokyo (JP)

(72) Inventor: Takuro Furusawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 109 days.

(21) Appl. No.: 18/623,470

(22) Filed: Apr. 1, 2024

(65) Prior Publication Data

US 2024/0327149 A1 Oct. 3, 2024

(30) Foreign Application Priority Data

Apr. 3, 2023 (JP) ..... 2023-059987
Sep. 20, 2023 (JP) ..... 2023-152045

(51) Int. Cl.
*B65H 3/06* (2006.01)
*B65H 43/02* (2006.01)

(52) U.S. Cl.
CPC ..... *B65H 3/0684* (2013.01); *B65H 3/0669* (2013.01); *B65H 43/02* (2013.01); *B65H 2403/72* (2013.01); *B65H 2515/32* (2013.01)

(58) Field of Classification Search
CPC . B65H 3/0669; B65H 3/0684; B65H 2403/51
USPC ..... 271/117, 118
See application file for complete search history.

(56) References Cited

U.S. PATENT DOCUMENTS 6,467,765 B2 * 10/2002 Yukimachi ..... B65H 3/0615 271/117
7,648,134 B2 1/2010 Lim
8,430,393 B2 * 4/2013 Matsushima ..... B65H 3/0669 271/10.09
9,221,634 B2 12/2015 Tanaka
10,280,018 B2 5/2019 Kondo
10,466,626 B2 11/2019 Yang
11,697,562 B2 * 7/2023 Fukada ..... B65H 7/18 271/157
2009/0014940 A1 1/2009 Lim
(Continued)

FOREIGN PATENT DOCUMENTS

JP 2001-302006 A 10/2001
JP 2016-179897 A 10/2016

*Primary Examiner* — Jeremy R Severson
(74) *Attorney, Agent, or Firm* — WORKMAN NYDEGGER

(57) ABSTRACT

A medium feeding apparatus includes a driving portion that drives a feeding roller, an arm portion that supports the feeding roller, and a displacement portion that can come into contact with the arm portion. The arm portion displaces the feeding roller between a contact position and a separation position. The contact position is a position where the feeding roller comes into contact with the medium, and the separation position is a position where the feeding roller is separated from the medium. The displacement portion rotates the arm portion to displace the feeding roller from the separation position to the contact position by using forward rotation power from the driving portion, and rotates the arm portion to displace the feeding roller from the contact position to the separation position by using reverse rotation power from the driving portion.

19 Claims, 14 Drawing Sheets

(56) References Cited

U.S. PATENT DOCUMENTS

| | | | |
|---|---|---|---|
| 2016/0046456 | A1 | 2/2016 | Woo |
| 2022/0267107 | A1 | 8/2022 | Nukui |

* cited by examiner

MEDIUM FEEDING APPARATUS, RECORDING APPARATUS, AND CONTROL METHOD FOR RECORDING APPARATUS

The present application is based on, and claims priority from JP Application Serial Number 2023-059987, filed Apr. 3, 2023 and JP Application Serial Number 2023-152045, filed Sep. 20, 2023, the disclosures of which are hereby incorporated by reference herein in their entirety.

BACKGROUND

1. Technical Field

The present disclosure relates to a medium feeding apparatus, a recording apparatus, and a control method for the recording apparatus.

2. Related Art

For example, JP-A-2001-302006 discloses a medium feeding apparatus including a feeding roller that feeds a medium placed on a medium placement portion, an arm portion that accommodates the feeding roller, and a roller driving portion that drives the feeding roller. Such a medium feeding apparatus is configured so that the feeding roller is retracted from the medium by rotation of a cam. In this way, by suppressing contact of the feeding roller with the medium, it is possible to suppress bleed marks due to the feeding roller.

However, in such a medium feeding apparatus, a cam driving portion for rotating the cam is provided in addition to the roller driving portion. This may lead to an increase in the size of the apparatus.

SUMMARY

According to an aspect of the present disclosure, there is provided a medium feeding apparatus including: a feeding roller configured to feed a medium placed on a medium placement portion; a driving portion that drives the feeding roller; an arm portion that supports the feeding roller and is configured to rotate about a drive shaft; and a displacement portion that is configured to come into contact with the arm portion and rotates the arm portion by using forward rotation power from the driving portion, in which the feeding roller feeds the medium placed on the medium placement portion by using forward rotation power from the driving portion, the arm portion displaces the feeding roller between a contact position and a separation position, the contact position is a position where the feeding roller contacts the placed medium, the separation position is a position where the feeding roller is separated from the placed medium, and the displacement portion rotates the arm portion to displace the feeding roller from the separation position to the contact position by using forward rotation power from the driving portion, and rotates the arm portion to displace the feeding roller from the contact position to the separation position by using reverse rotation power from the driving portion.

According to another aspect of the present disclosure, there is provided a recording apparatus including a medium feeding apparatus and a recording portion that performs recording on a medium. The medium feeding apparatus includes: a feeding roller configured to feed a medium placed on a medium placement portion; a driving portion that drives the feeding roller; an arm portion that supports the feeding roller and is configured to rotate about a drive shaft; and a displacement portion that is configured to come into contact with the arm portion and rotates the arm portion by using forward rotation power from the driving portion, in which the feeding roller feeds the medium placed on the medium placement portion by using forward rotation power from the driving portion, the arm portion displaces the feeding roller between a contact position and a separation position, the contact position is a position where the feeding roller contacts the placed medium, the separation position is a position where the feeding roller is separated from the placed medium, and the displacement portion rotates the arm portion to displace the feeding roller from the separation position to the contact position by using forward rotation power from the driving portion, and rotates the arm portion to displace the feeding roller from the contact position to the separation position by using reverse rotation power from the driving portion. The recording portion performs recording on the medium fed by the feeding roller.

According to another aspect of the present disclosure, there is provided a control method for the recording apparatus described above, the displacement portion being configured to be displaced between a first position and a second position, the first position being a position where the feeding roller is displaced to the contact position, and the second position being a position where the feeding roller is displaced to the separation position, the control method including: displacing the displacement portion to the second position in at least any one of when there is no next job after a job of performing recording on a medium is ended, when there is no next job for a predetermined time after a job of performing recording on a medium is ended, and when power is turned off.

According to another aspect of the present disclosure, there is provided a recording apparatus including a medium feeding apparatus, a recording portion that performs recording on a medium, and a control portion. The medium feeding apparatus includes: a feeding roller configured to feed a medium placed on a medium placement portion; a driving portion that drives the feeding roller; an arm portion that supports the feeding roller and is configured to rotate about a drive shaft; and a displacement portion that is configured to come into contact with the arm portion and rotates the arm portion by using forward rotation power from the driving portion, in which the feeding roller feeds the medium placed on the medium placement portion by using forward rotation power from the driving portion, the arm portion displaces the feeding roller between a contact position and a separation position, the contact position is a position where the feeding roller contacts the placed medium, the separation position is a position where the feeding roller is separated from the placed medium, the displacement portion rotates the arm portion to displace the feeding roller from the separation position to the contact position by using forward rotation power from the driving portion, and rotates the arm portion to displace the feeding roller from the contact position to the separation position by using reverse rotation power from the driving portion, the displacement portion is configured to be displaced between a first position and a second position, the first position is a position where the feeding roller is displaced to the contact position due to non-contact with the arm portion, the second position is a position where the feeding roller is displaced to the separation position due to contact with the arm portion, and the displacement portion supports the arm portion from below in a vertical direction at the second position. The arm portion is attachable to and detachable from the drive shaft, and when the displacement portion is at the second position, the control portion displaces the displacement portion from the second position to the first position when the arm portion is attached to and detached from the drive shaft. The recording portion performs recording on the medium fed by the feeding roller.

According to another aspect of the present disclosure, there is provided a control method for a recording apparatus including the medium feeding apparatus described above, and a recording portion that performs recording on the medium fed by the feeding roller, the arm portion being attachable to and detachable from the drive shaft, the control method including: displacing, when the displacement portion is at the second position, the displacement portion from the second position to the first position when the arm portion is attached to and detached from the drive shaft.

DESCRIPTION OF EMBODIMENTS

First Embodiment

An embodiment of a medium feeding apparatus, a recording apparatus, and a control method for the recording apparatus will be described below. The recording apparatus includes a medium feeding apparatus. In the following description, a direction intersecting a vertical direction Z is referred to as a width direction X, and a direction intersecting the vertical direction Z and the width direction X is referred to as a front-rear direction Y. One direction in the width direction X is referred to a first width direction X1, and the other direction in the width direction X is referred to a second width direction X2. One direction in the front-rear direction Y is referred to as a front side Y1, and the other direction in the front-rear direction Y is referred to as a rear side Y2. The upper side of the vertical direction Z is referred to as an upper side Z1, and the lower side (below) of the vertical direction Z is referred to as a lower side Z2.

Configuration of Recording Apparatus 11

Figure 1:
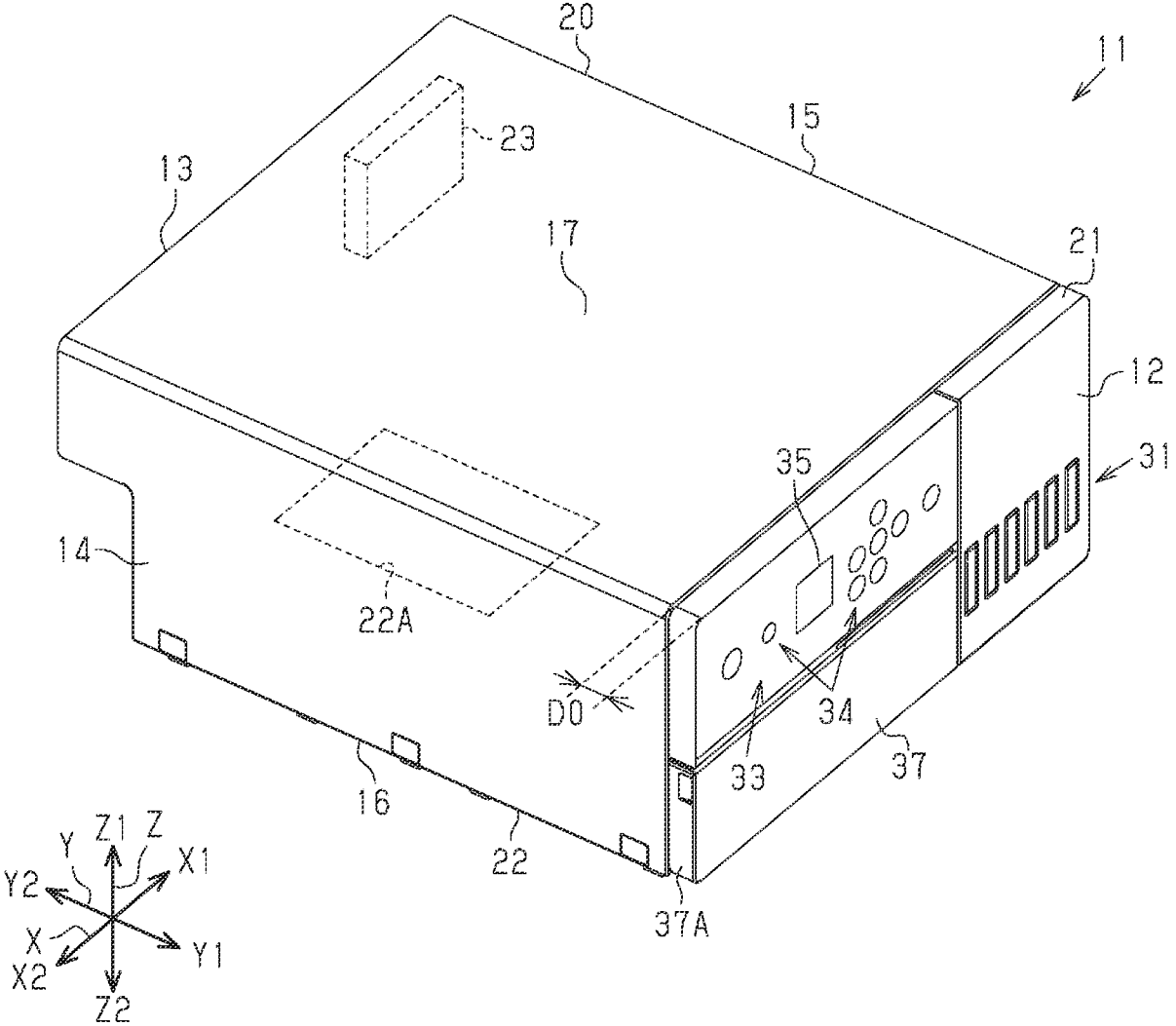
FIG. 1 is a perspective view showing a recording apparatus according to a first embodiment.

As shown in FIG. 1, a recording apparatus 11 is an apparatus that performs recording on a medium. The recording apparatus 11 may be an apparatus that performs recording on a medium by ejecting a liquid. The liquid may be ink, for example. The liquid may be a plurality of colors or one color, for example. The medium may be paper, for example. The paper includes photo paper, which will be described later. The recording apparatus 11 may be an apparatus capable of performing recording on a plurality of types of paper.

The recording apparatus 11 is configured in the shape of a rectangular parallelepiped. The recording apparatus 11 includes a front surface 12. The front surface 12 is a plane facing the front side Y1. The recording apparatus 11 includes a back surface 13. The back surface 13 is a plane facing the rear side Y2. The recording apparatus 11 includes a left side surface 14. The left side surface 14 is a plane facing in the second width direction X2. The recording apparatus 11 includes a right side surface 15. The right side surface 15 is a plane facing in the first width direction X1. The recording apparatus 11 includes a bottom surface 16. The bottom surface 16 is a plane facing the lower side Z2. The recording apparatus 11 includes a top surface 17. The top surface 17 is a plane facing the upper side Z1.

In this way, the top surface 17 includes a flat surface on which objects to be loaded can be loaded. The object to be loaded may be another recording apparatus 11 or a laptop computer. The top surface 17 may be flat in all areas or may not be flat in some areas, as long as it includes a flat surface on which objects to be loaded can be loaded.

The recording apparatus 11 includes a housing 20 and a main body 21. The housing 20 is configured to accommodate the main body 21. The housing 20 constitutes at least a part of the left side surface 14, a part of the right side surface 15, a part of the bottom surface 16, and a part of the top surface 17 of the recording apparatus 11, but may constitute at least the entire left side surface 14, the entire right side surface 15, the entire bottom surface 16, and the entire top surface 17 of the recording apparatus 11.

In this way, the housing 20 has a plurality of surfaces such as the left side surface 14, the right side surface 15, the bottom surface 16, and the top surface 17 of the recording apparatus 11. It can be said that the left side surface 14, the right side surface 15, the bottom surface 16, and the top surface 17 of the recording apparatus 11 are the left side surface, the right side surface, the bottom surface, and the top surface of the housing 20, respectively. Note that the housing 20 may include at least a part of the front surface 12 of the recording apparatus 11. The housing 20 may include at least a part of the back surface 13 of the recording apparatus 11.

The main body 21 constitutes at least the entire front surface 12 of the recording apparatus 11, but may constitute at least a part of the front surface 12 of the recording apparatus 11. Accordingly, the main body 21 has the front surface 12 of the recording apparatus 11. It can be said that the front surface 12 of the recording apparatus 11 is the front surface of the main body 21. Further, the back surface 13 of the recording apparatus 11 may be composed of the back surface of the housing 20 and the back surface of the main body 21, but may be composed of only the back surface of the housing 20 or may be composed of only the back surface of the main body 21.

The housing 20 includes a flat bottom plate 22. The bottom plate 22 is made of metal, but may be made of resin, or may be composed of both a metal plate and a resin plate. The bottom plate 22 includes a through hole 22A. The through hole 22A opens the bottom plate 22 along the vertical direction Z. The through hole 22A is a hole for attaching and detaching a member accommodated in the housing 20 to and from the lower side Z2 of the bottom plate 22.

The recording apparatus 11 includes an accommodation amount viewing portion 31. The accommodation amount viewing portion 31 is provided in the main body 21. The accommodation amount viewing portion 31 can visually check the accommodation amount of the liquid in a liquid accommodation portion 40, which will be described later. The accommodation amount viewing portion 31 is composed of a plurality of viewing windows corresponding to each color of liquid.

The recording apparatus 11 includes an operation panel 33. The operation panel 33 is provided on the main body 21. The operation panel 33 includes an operation portion 34 and a display portion 35. The operation portion 34 can be operated by a user. The operation portion 34 may be composed of a plurality of operation buttons. The display portion 35 displays information regarding the recording apparatus 11. The operation panel 33 is located on the front surface 12 of the recording apparatus 11.

The main body 21 is configured to be displaceable along the front-rear direction Y with respect to the housing 20. Specifically, the main body 21 is configured to be displaceable between a closed position, a first open position, and a second open position along the front-rear direction Y with respect to the housing 20.

The main body 21 can be disposed at the closed position. The closed position is a position where the main body 21 is accommodated in the housing 20. The closed position is a position where the main body 21 protrudes from the housing 20 toward the front side Y1 by a predetermined distance DO, but may be a position where the main body 21 does not protrude from the housing 20. That is, the main body 21 constitutes a part of the left side surface 14, a part of the right side surface 15, a part of the bottom surface 16, and a part of the top surface 17 of the recording apparatus 11, but may not constitute the left side surface 14, the right side surface 15, the bottom surface 16, and the top surface 17 of the recording apparatus 11.

Figure 2:
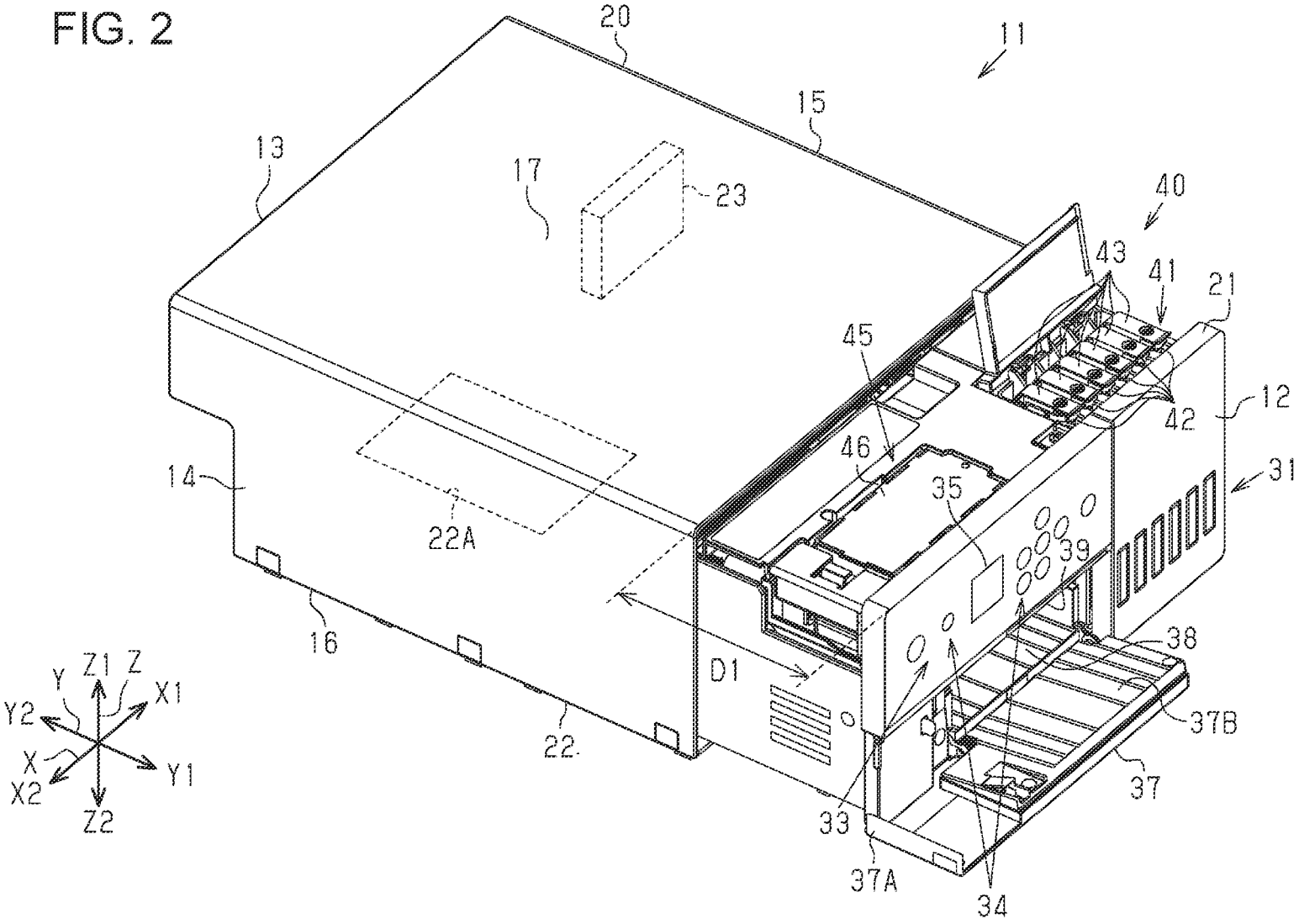
FIG. 2 is a perspective view showing the recording apparatus according to the first embodiment.

As shown in FIG. 2, the main body 21 can be displaced at the first open position. The first open position is an open position where the main body 21 protrudes from the housing 20 toward the front side Y1. In particular, the first open position is a position where the main body 21 protrudes from the housing 20 by a first distance D1 toward the front side Y1. The first distance D1 is a distance longer than the predetermined distance DO. In this way, when the main body 21 is disposed at the first open position, at least a part of the inside of the main body 21 is exposed from the housing 20.

Figure 3:
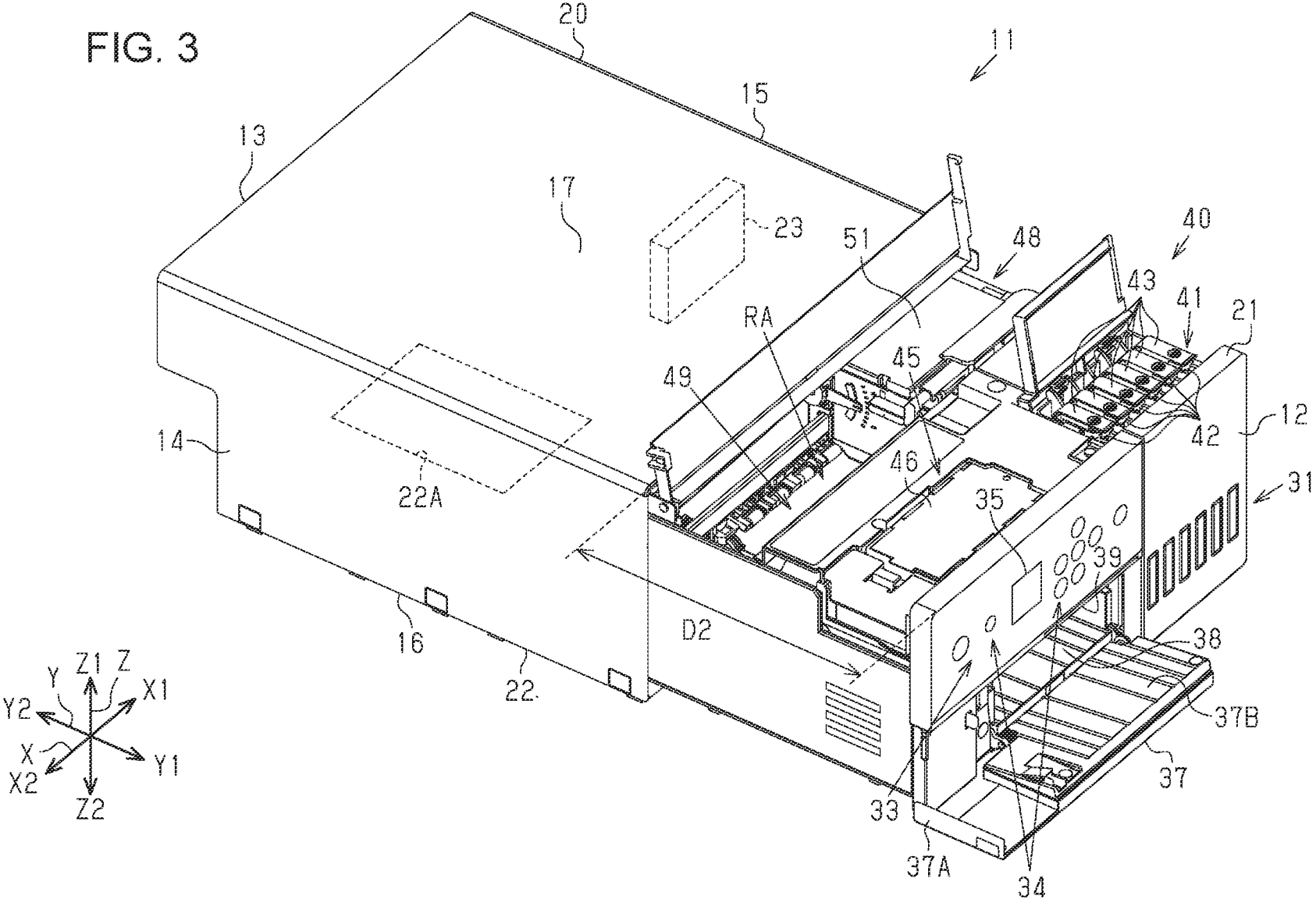
FIG. 3 is a perspective view showing the recording apparatus according to the first embodiment.

As shown in FIG. 3, the main body 21 can be displaced at the second open position. The second open position is an open position where the main body 21 protrudes from the housing 20 toward the front side Y1. In particular, the second open position is a position where the main body 21 protrudes from the housing 20 by a second distance D2 toward the front side Y1. The second distance D2 is a distance longer than the first distance D1. In this way, when the main body 21 is disposed at the second open position, at least a part of the inside of the main body 21 is exposed from the housing 20.

The recording apparatus 11 includes a control portion 23. The control portion 23 is mounted on the main body 21. The control portion 23 is accommodated in the housing 20. The control portion 23 is not exposed from the housing 20 when the main body 21 is disposed at the closed position, the first open position, and the second open position.

The control portion 23 controls the recording apparatus 11. The control portion 23 controls various operations executed by the recording apparatus 11. The control portion 23 can be configured as a circuit including a: one or more processors that execute various processes according to a computer program, B: one or more dedicated hardware circuits that execute at least some of various processes, or y: a combination thereof. The hardware circuit is, for example, an application-specific integrated circuit. The processor includes a CPU and a memory, such as a RAM and a ROM, and the memory stores program codes or instructions configured to cause the CPU to execute processing. The memory, that is, a computer readable medium includes any readable medium that can be accessed by a general-purpose or dedicated computer.

The recording apparatus 11 includes an opening/closing portion 37. The opening/closing portion 37 is provided in the main body 21. The opening/closing portion 37 is located on the front surface 12 of the recording apparatus 11. The opening/closing portion 37 is configured to be rotatable about a rotation axis along the width direction X at a lower end portion 37A. Thereby, the opening/closing portion 37 is configured to be openable/closable with respect to the front surface 12 of the recording apparatus 11.

The recording apparatus 11 includes a discharge port 38. The discharge port 38 is provided in the main body 21. The discharge port 38 is an opening that discharges a medium recorded by a recording portion 48, which will be described later. The discharge port 38 opens to the front side Y1 of the recording apparatus 11. That is, the discharge port 38 is provided in the front surface 12 of the recording apparatus 11 to open toward the front side Y1. In other words, the discharge port 38 is provided in the front surface of the main body 21 to open toward the front side Y1.

The discharge port 38 is exposed at the front side Y1 of the recording apparatus 11 when the opening/closing portion 37 is open. The discharge port 38 is not exposed when the opening/closing portion 37 is closed, but it may be exposed even when the opening/closing portion 37 is closed. The discharge port 38 is located in the second width direction X2 of the liquid accommodation portion 40, which will be described later.

The recording apparatus 11 includes a paper discharge tray 37B. The paper discharge tray 37B is provided in the main body 21. The paper discharge tray 37B is provided on the inner wall surface of the opening/closing portion 37. The paper discharge tray 37B is exposed when the opening/closing portion 37 is open, and a medium after recording can be placed thereon. The paper discharge tray 37B may be configured to be extendable and retractable in the front-rear direction Y.

The recording apparatus 11 includes a grip portion 39. The grip portion 39 is provided on the main body 21. The grip portion 39 is provided on the upper side Z1 of the discharge port 38. The grip portion 39 is provided on the front surface 12 of the recording apparatus 11 at a position where it can be gripped by the user from the front side Y1. That is, the grip portion 39 is provided on the surface of the main body 21 facing the front side Y1 at a position where it can be gripped by the user from the front side Y1. In this way, the grip portion 39 can be gripped by the user when displacing the main body 21 in the front-rear direction Y. In particular, even when a plurality of recording apparatuses 11 are stacked in the vertical direction Z or when a plurality of recording apparatuses 11 are installed side by side in the width direction X, the grip portion 39 can be easily gripped by the user from the front side Y1.

As shown in FIG. 2, the recording apparatus 11 includes a liquid accommodation portion 40. The liquid accommodation portion 40 is mounted on the main body 21. The liquid accommodation portion 40 is configured to accommodate a liquid used for recording on a medium. That is, the liquid accommodation portion 40 is configured to accommodate a liquid to be supplied to the recording portion 48, which will be described later. The liquid accommodation portion 40 may be a tank-shaped accommodation portion into which a liquid can be poured.

The liquid accommodation portion 40 includes an accommodation chamber 41, a liquid pouring port 42, and a cap 43. The accommodation chamber 41 is configured to accommodate a liquid. The liquid pouring port 42 is an opening configured to allow a liquid to be poured into the accommodation chamber 41. The cap 43 covers the liquid pouring port 42. The cap 43 can suppress drying in the accommodation chamber 41 by sealing the accommodation chamber 41. By removing the cap 43 from the liquid pouring port 42, it becomes possible to pour the liquid from the liquid pouring port 42 into the accommodation chamber 41. The liquid accommodation portion 40 may include a plurality of accommodation chambers 41, a plurality of liquid pouring ports 42, and a plurality of caps 43, each corresponding to each color of liquid.

The liquid accommodation portion 40 is not exposed from the housing 20 when the main body 21 is disposed at the closed position. The liquid accommodation portion 40 is exposed from the housing 20 when the main body 21 is disposed at the first open position. Thus, when the main body 21 is disposed at the first open position, the liquid pouring port 42 is exposed from the housing 20 by removing the cap 43. Thereby, the liquid can be poured from the liquid pouring port 42 into the accommodation chamber 41. The liquid accommodation portion 40 is exposed from the housing 20 even when the main body 21 is disposed at the second open position.

The recording apparatus 11 includes a waste liquid mounting portion 45. The waste liquid mounting portion 45 is configured such that a waste liquid accommodating body 46 can be mounted thereon. The waste liquid accommodating body 46 is configured such that a liquid discharged as a waste liquid from the recording portion 48, which will be described later, can be collected via a maintenance device (not shown). The waste liquid mounting portion 45 is mounted on the main body 21. The waste liquid mounting portion 45 is provided on the upper side Z1 of the discharge port 38.

The waste liquid mounting portion 45 is not exposed from the housing 20 when the main body 21 is disposed at the closed position. The waste liquid mounting portion 45 is exposed from the housing 20 when the main body 21 is disposed at the first open position. In this way, when the main body 21 is disposed at the first open position, the waste liquid mounting portion 45 is exposed from the housing 20. Thereby, the waste liquid accommodating body 46 can be attached to and detached from the waste liquid mounting portion 45. Note that the waste liquid mounting portion 45 is exposed from the housing 20 also when the main body 21 is disposed at the second open position.

As shown in FIG. 3, the recording apparatus 11 includes a recording portion 48. The recording portion 48 is configured to perform recording on a medium. The recording portion 48 may be configured to perform recording on the medium by ejecting a liquid onto the medium. The recording portion 48 is mounted on the main body 21. The recording portion 48 is provided at a position adjacent to the liquid accommodation portion 40 in the front-rear direction Y. The recording portion 48 is provided on the rear side Y2 with respect to the liquid accommodation portion 40.

The recording portion 48 is exposed from the housing 20 when the main body 21 is disposed at the second open position. In particular, a carriage 51, which will be described later, is exposed from the housing 20 when the main body 21 is disposed at the second open position. The recording portion 48 is not exposed from the housing 20 when the main body 21 is disposed at the closed position and the first open position.

The recording apparatus 11 includes a transport path 49. The transport path 49 is a path for transporting the medium. The transport path 49 is provided in the main body 21. A part of the transport path 49 is exposed from the housing 20 when the main body 21 is disposed at the second open position. In particular, in the transport path 49, a recording area RA in which recording is performed on a medium by the recording portion 48 is exposed from the housing 20 when the main body 21 is disposed at the second open position. A part of the transport path 49 is not exposed from the housing 20 when the main body 21 is disposed at the closed position and the first open position.

Figure 4:
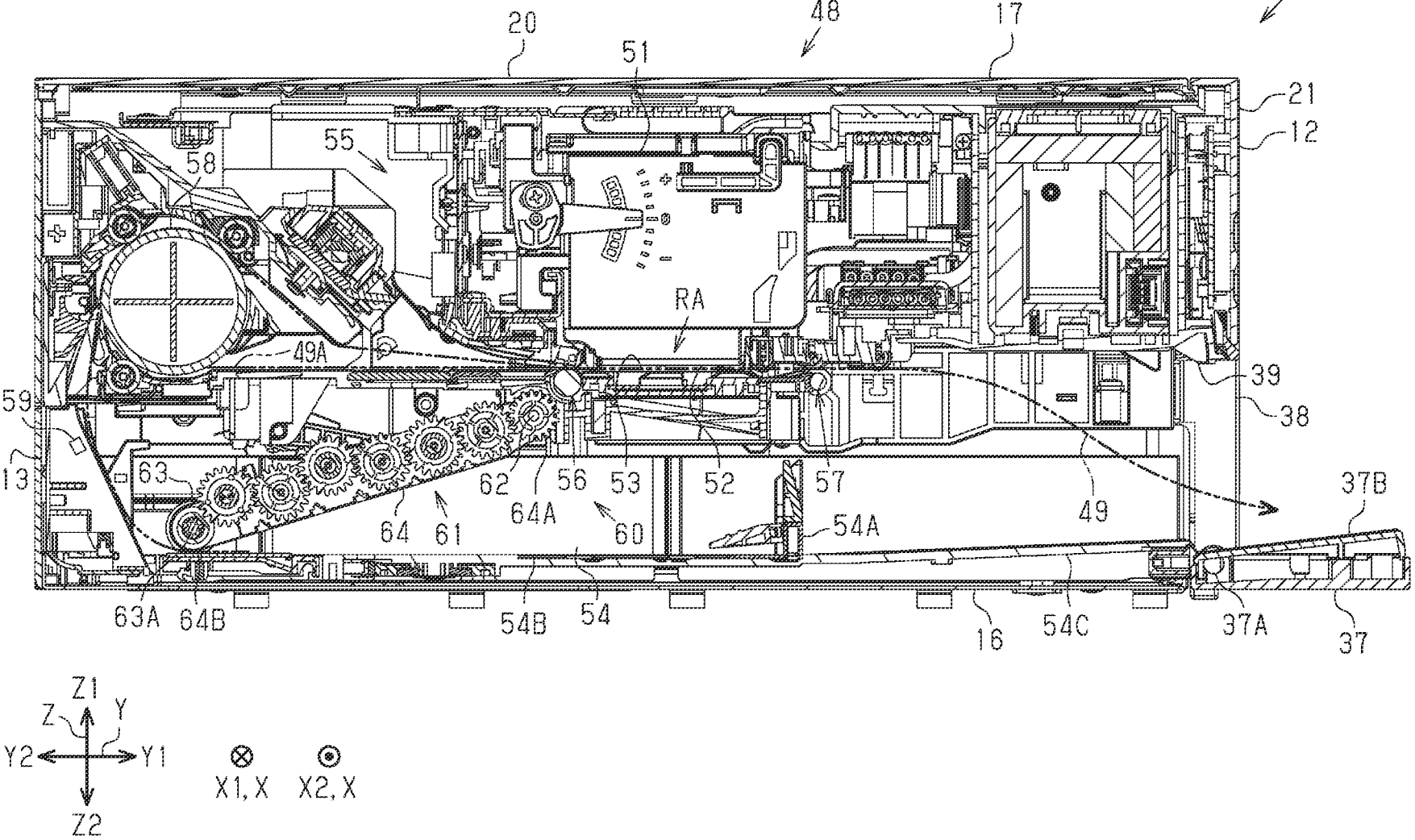
FIG. 4 is a sectional view showing the recording apparatus according to the first embodiment.

As shown in FIG. 4, the recording portion 48 includes a carriage 51 and a liquid ejecting head 52. The carriage 51 supports the liquid ejecting head 52 from the upper side Z1. The liquid ejecting head 52 is provided on the lower side Z2 of the carriage 51. That is, the liquid ejecting head 52 is mounted on the carriage 51.

The liquid ejecting head 52 includes a plurality of nozzles (not shown). Each of the plurality of nozzles opens toward a medium supported by a support portion 53, which will be described later. Each of the plurality of nozzles ejects a liquid. The liquid ejecting head 52 ejects a liquid from the plurality of nozzles toward the medium supported by the support portion 53. In this way, the recording portion 48 is configured to perform recording on the medium by ejecting the liquid onto the medium. The liquid ejecting head 52 is a serial head type that ejects a liquid as the carriage 51 moves in the width direction X, but may be a line head type.

The recording apparatus 11 includes a support portion 53. The support portion 53 is mounted on the main body 21. The support portion 53 is configured to support the medium. In particular, the support portion 53 supports the medium in the recording area RA where the recording is performed on the medium by the recording portion 48.

The recording apparatus 11 includes a medium placement portion 54. The medium placement portion 54 can place one or a plurality of media thereon. The medium placement portion 54 may be a tray on which the medium can be placed. The medium placement portion 54 is mounted on the main body 21. The medium placement portion 54 can be displaced from the main body 21 along the front-rear direction Y. By being pulled out from the main body 21 to the front side Y1, the medium placement portion 54 is brought into a state in which the medium can be placed and the medium can be unloaded. In this way, the front side Y1 corresponds to an example of the pull-out direction in which the medium placement portion 54 is pulled out.

The medium placement portion 54 includes a partition plate 54A. The partition plate 54A is located at the center of the medium placement portion 54 in the front-rear direction Y. The partition plate 54A partitions the medium placement portion 54 in the front-rear direction Y. The medium placement portion 54 includes a first medium placement portion 54B. The medium placement portion 54 may include a second medium placement portion 54C. The first medium placement portion 54B and the second medium placement portion 54C are parts partitioned in the front-rear direction Y by the partition plate 54A. The first medium placement portion 54B is located on the rear side Y2 with respect to the second medium placement portion 54C. The first medium placement portion 54B can place one or a plurality of media before being read thereon. The second medium placement portion 54C can place one or a plurality of media after reading thereon.

The recording apparatus 11 includes a medium feeding apparatus 60. The medium feeding apparatus 60 is located on the upper side Z1 of the medium placement portion 54 when the medium placement portion 54 is mounted on the main body 21. Specifically, the medium feeding apparatus 60 is located on the upper side Z1 of the first medium placement portion 54B when the medium placement portion 54 is mounted on the main body 21. The medium feeding apparatus 60 feeds the media placed on the medium placement portion 54 one by one.

The recording apparatus 11 includes a transport portion 55. The transport portion 55 is configured to transport the medium. The transport portion 55 is mounted on the main body 21. The transport portion 55 transports the medium fed by the medium feeding apparatus 60 along the transport path 49.

The transport portion 55 includes a plurality of rollers and a plurality of motors serving as a driving source. In particular, the transport portion 55 includes a transport roller pair 56. The transport roller pair 56 is located upstream of the transport path 49 of the support portion 53. The transport roller pair 56 transports the medium along the transport path 49 to the support portion 53. Further, the transport portion 55 includes a discharge roller pair 57. The discharge roller pair 57 is located downstream of the transport path 49 of the support portion 53. The discharge roller pair 57 discharges the medium after recording along the transport path 49.

In this way, the medium placed on the medium placement portion 54 is fed by the medium feeding apparatus 60. Then, the medium fed by the medium feeding apparatus 60 is transported along the transport path 49 by the transport portion 55. Thereby, the recording portion 48 performs recording on the medium transported along the transport path 49 by the transport portion 55. That is, the recording portion 48 performs recording on the medium fed by the medium feeding apparatus 60. In other words, the recording portion 48 performs recording on a medium fed by a feeding roller 63, which will be described later.

The transport portion 55 includes a reversing portion 58. That is, the reversing portion 58 is mounted on the main body 21. The recording apparatus 11 also includes the reversing portion 58. The reversing portion 58 may be configured to be attachable to and detachable from the main body 21 from the rear side Y2. The reversing portion 58 includes a plurality of rollers. The reversing portion 58 is configured to transport the medium along the transport path 49.

The transport path 49 includes a reversing path 49A. The reversing path 49A is a path that couples the transport roller pair 56 and the reversing portion 58. The reversing path 49A extends along the front-rear direction Y. After recording is performed on the surface of the medium by the recording portion 48 in the recording area RA, the transport roller pair 56 transports the medium to the reversing portion 58 along the reversing path 49A. The reversing portion 58 is configured to transport the medium along the transport path 49 in a state in which the medium transported along the reversing path 49A is reversed. That is, the reversing portion 58 reverses the medium fed by the medium feeding apparatus 60.

In this way, the medium reversed by the reversing portion 58 is transported again to the recording area RA, and accordingly, the recording portion 48 can perform recording on the back surface of the medium. Thereby, the recording portion 48 can perform printing on both sides of the medium. That is, the recording portion 48 can perform recording after the medium is reversed by the reversing portion 58. In particular, the recording portion 48 may be capable of recording on photo paper, which can be double-sided printed, as the medium.

The recording apparatus 11 includes a medium detection portion 59. The medium detection portion 59 is provided along the transport path 49. The medium detection portion 59 may be provided between the medium placement portion 54 and the reversing portion 58 in the transport path 49, or may be provided between the reversing portion 58 and the transport roller pair 56. The medium detection portion 59 detects the tip of the medium fed by the medium feeding apparatus 60. Specifically, the medium detection portion 59 detects the tip of the medium fed by the feeding roller 63, which will be described later.

Configuration of Medium Feeding Apparatus 60

Here, the medium feeding apparatus 60 will be described in detail.

Figure 5:
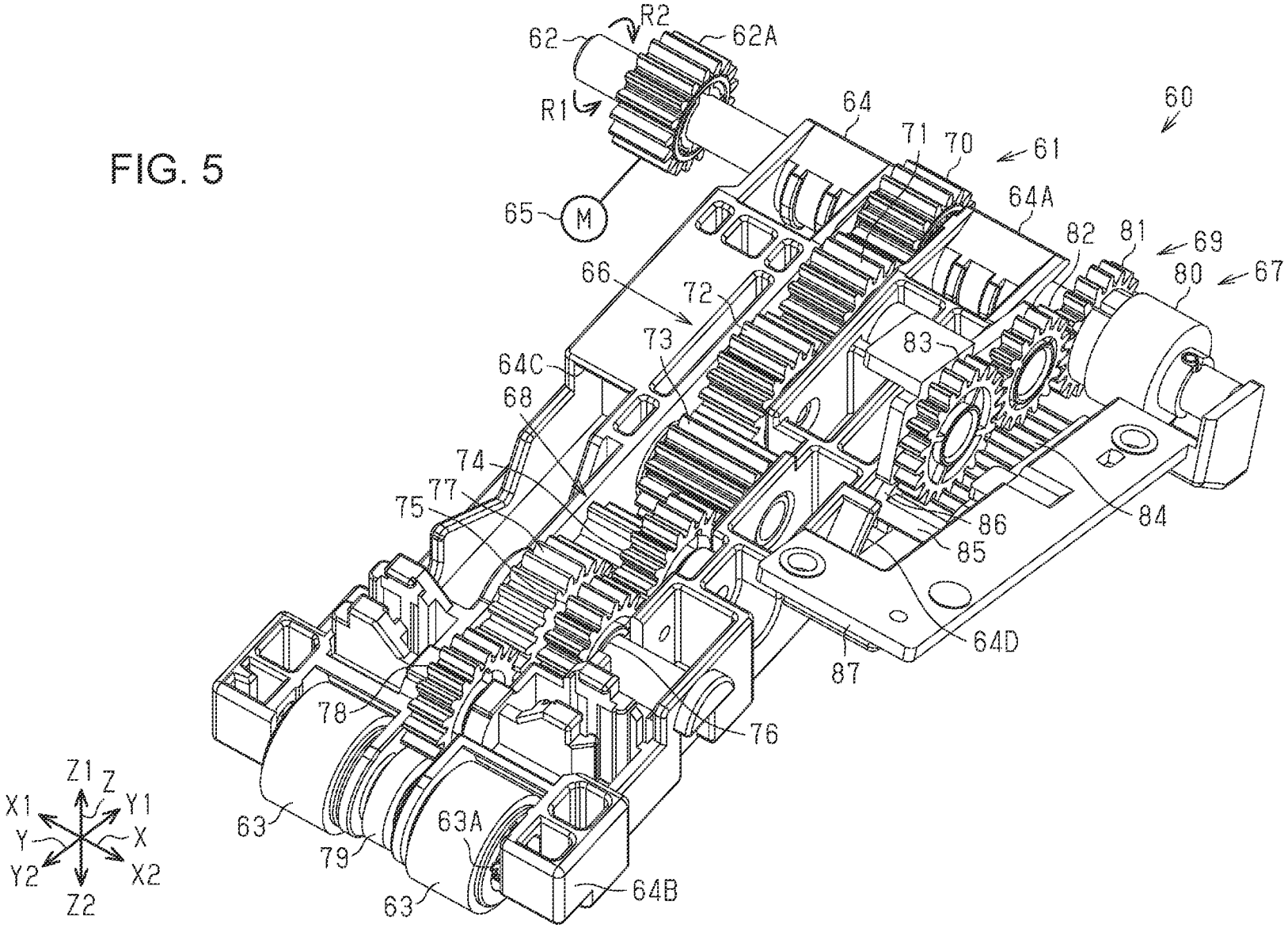
FIG. 5 is a perspective view showing a medium feeding apparatus according to the first embodiment.

As shown in FIGS. 4 and 5, the medium feeding apparatus 60 includes a feeding roller unit 61 and a drive shaft 62. The feeding roller unit 61 is provided rotatably about the drive shaft 62. The drive shaft 62 extends along the width direction X. The drive shaft 62 may be a drive shaft for transmitting power to the feeding roller unit 61.

The feeding roller unit 61 includes a feeding roller 63. That is, the medium feeding apparatus 60 includes the feeding roller 63. The feeding roller unit 61 may include a plurality of feeding rollers 63. The feeding roller unit 61 includes an arm portion 64. That is, the medium feeding apparatus 60 includes the arm portion 64.

The feeding roller 63 is accommodated in the arm portion 64. The feeding roller 63 is provided at a tip portion 64B of the arm portion 64. The feeding roller 63 is rotatably supported about a first rotating shaft 63A. The first rotating shaft 63A extends along the width direction X. The feeding roller 63 can feed the medium placed on the medium placement portion 54.

The arm portion 64 accommodates various members including the feeding roller 63. The arm portion 64 includes a base end portion 64A and the tip portion 64B. The base end portion 64A may be located on the front side Y1 with respect to the tip portion 64B.

The arm portion 64 is provided rotatably about the drive shaft 62 at the base end portion 64A. That is, the arm portion 64 is rotatable about the drive shaft 62. Further, the drive shaft 62 is configured to rotatably support the arm portion 64.

The arm portion 64 is attachable to and detachable from the drive shaft 62. Specifically, in a state in which the main body 21 is at the closed position and the medium placement portion 54 is removed from the main body 21, the arm portion 64 is exposed via the through hole 22A. In this way, in a state in which the main body 21 is at the closed position and the medium placement portion 54 is removed from the main body 21, the arm portion 64 is attachable and detachable via the through hole 22A.

The arm portion 64 rotatably supports the feeding roller 63 at the tip portion 64B. In particular, the arm portion 64 swingably supports the feeding roller 63 by providing clearance between the arm portion 64 and the feeding roller 63.

The arm portion 64 causes the feeding roller 63 to advance and retreat with respect to the medium placed on the medium placement portion 54 by rotating about the drive shaft 62. The arm portion 64 can bring the feeding roller 63 into contact with the medium placed on the medium placement portion 54. The inclination angle of the arm portion 64 can be changed depending on the number of media placed on the medium placement portion 54. In this way, the arm portion 64 is displaceable to change the distance between the feeding roller 63 and the medium placement portion 54 depending on the number of media placed on the medium placement portion 54. That is, the arm portion 64 can displace the feeding roller 63 depending on the inclination angle.

As shown in FIG. 5, the arm portion 64 includes an engaged portion 64C. The engaged portion 64C can engage with a second engaging portion 30F, which will be described later. The engaged portion 64C may be an engagement recess portion that opens toward the rear side Y2.

Figure 6:
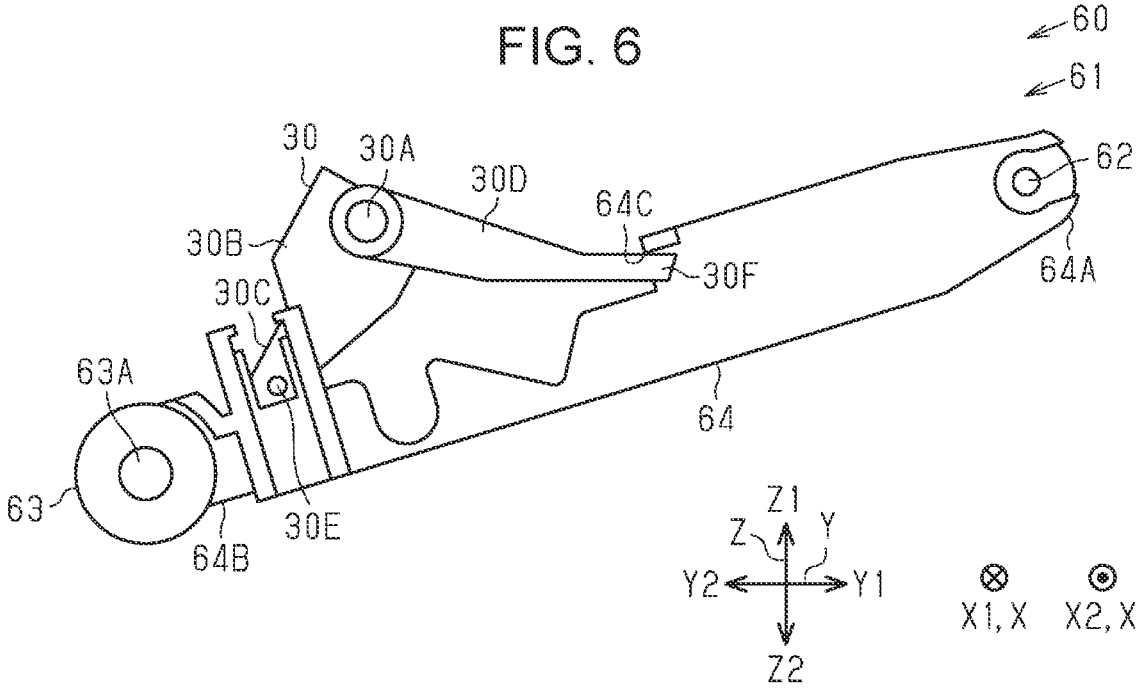
FIG. 6 is a schematic diagram showing the medium feeding apparatus according to the first embodiment.
Figure 7:
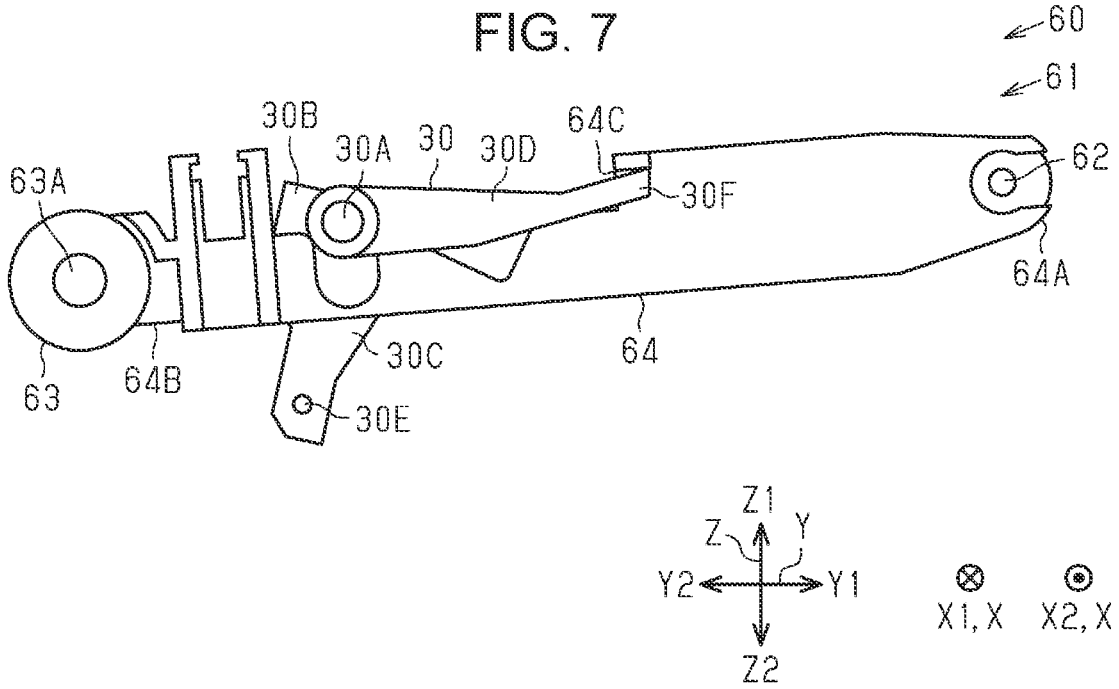
FIG. 7 is a schematic diagram showing the medium feeding apparatus according to the first embodiment.

As shown in FIGS. 6 and 7, the arm portion 64 can be displaced between a feeding position and a retracted position by rotating about the drive shaft 62. As shown in FIG. 6, the feeding position is a position where the medium placed on the medium placement portion 54 can be fed. The feeding position is a position where the feeding roller 63 is displaced to a contact position. The contact position is a position where the feeding roller 63 contacts the medium placed on the medium placement portion 54.

As shown in FIG. 7, the retracted position is a position that does not interfere with the pulling-out of the medium placement portion 54. The retracted position is a position where the feeding roller 63 is displaced to a separation position. The separation position is a position where the feeding roller 63 is separated from the medium placed on the medium placement portion 54.

The recording apparatus 11 includes an arm retraction portion 30. The arm retraction portion 30 is configured to retract the arm portion 64 to a retracted position when pulling out the medium placement portion 54 in a pull-out direction. As shown in FIG. 7, the retracted position is a position that does not interfere with the pulling-out of the medium placement portion 54.

The arm retraction portion 30 is provided in the main body 21. The arm retraction portion 30 has an L shape when viewed in the width direction X. The arm retraction portion 30 is provided rotatably about a shaft 30A. The shaft 30A extends along the width direction X.

The arm retraction portion 30 includes a main body portion 30B, a first lever 30C, and a second lever 30D. The first lever 30C protrudes the lower side Z2 from the main body portion 30B. The second lever 30D protrudes from the main body portion 30B toward the front side Y1.

The arm retraction portion 30 includes a first engaging portion 30E and a second engaging portion 30F. The first engaging portion 30E is provided at the tip portion of the first lever 30C. The first engaging portion 30E can engage with a slide member (not shown). The first engaging portion 30E may be an engagement hole. The second engaging portion 30F is provided at the tip portion of the second lever 30D. The second engaging portion 30F can engage with the engaged portion 64C. The second engaging portion 30F may be an engagement projection portion.

In the arm retraction portion 30, a biasing force is applied toward the upper side Z1 by a biasing member (not shown). The arm portion 64 is located at the retracted position when no external force is applied. The arm portion 64 may be displaced between the feeding position and the retracted position by using a driving force of a motor (not shown). In the arm portion 64, a biasing force may be applied toward the lower side Z2 by a biasing member (not shown).

The slide member slides toward the rear side Y2 as the medium placement portion 54 is mounted on the rear side Y2. In this case, as shown in FIG. 6, the first engaging portion 30E also moves to the rear side Y2. Thereby, the arm retraction portion 30 rotates about the shaft 30A against the biasing force from the biasing member. The arm retraction portion 30 then displaces the arm portion 64 from the retracted position to the feeding position.

The slide member becomes capable of sliding to the front side Y1 as the medium placement portion 54 is pulled out to the front side Y1. In this way, when the slide member slides to the front side Y1, as shown in FIG. 7, the arm retraction portion 30 rotates about the shaft 30A by receiving the biasing force from the biasing member. The arm retraction portion 30 displaces the arm portion 64 from the feeding position to the retracted position.

As shown in FIG. 5, the medium feeding apparatus 60 includes a driving portion 65. The driving portion 65 is a power source for the feeding roller unit 61. The driving portion 65 may be a motor. The driving portion 65 supplies power to the feeding roller unit 61 by rotating the drive shaft 62. Specifically, the driving portion 65 supplies power to the feeding roller unit 61 by rotating a gear 62A that is pivotally attached to the drive shaft 62. In particular, the driving portion 65 drives the feeding roller 63. The driving portion 65 drives a displacement portion 86, which will be described later.

The driving portion 65 can perform forward rotation drive and reverse rotation drive. The forward rotation drive is a drive that can supply forward rotation power to the feeding roller unit 61. The forward rotation power is power for causing the feeding roller 63 to rotate forward. The reverse rotation drive is a drive that can supply reverse rotation power to the feeding roller unit 61. The reverse rotation power is power that acts in the direction opposite to the forward rotation power. The drive shaft 62 can rotate in a first rotation direction R1 when the forward rotation power of the driving portion 65 is transmitted. The drive shaft 62 can rotate in a second rotation direction R2 when the reverse rotation power of the driving portion 65 is transmitted.

Configuration of Displacement Unit 67

The medium feeding apparatus 60 includes a displacement unit 67. The displacement unit 67 is provided separately from the feeding roller unit 61. The displacement unit 67 is provided on the second width direction X2 side with respect to the feeding roller unit 61.

The displacement unit 67 is a unit that displaces the feeding roller 63. Specifically, the displacement unit 67 is a unit that displaces the feeding roller 63 by displacing the arm portion 64.

The displacement unit 67 includes a unit housing 87. The unit housing 87 accommodates various members constituting the displacement unit 67. The displacement unit 67 is fixed to the main body 21. Therefore, the unit housing 87 is not displaced according to the power from the driving portion 65.

Configuration of Power Transmission Portion 66

The medium feeding apparatus 60 includes a power transmission portion 66. The power transmission portion 66 can transmit power from the driving portion 65 to the feeding roller 63. The power transmission portion 66 can transmit the power from the driving portion 65 to the displacement portion 86, which will be described later.

The power transmission portion 66 includes a first power transmission portion 68 and a second power transmission portion 69. The first power transmission portion 68 is accommodated in the arm portion 64. The second power transmission portion 69 is accommodated in the displacement unit 67.

The first power transmission portion 68 is a transmission portion used as a first transmission path. The first transmission path is a transmission path for transmitting power from the driving portion 65 to the feeding roller 63. The first power transmission portion 68 is a transmission portion to which power from the driving portion 65 is transmitted by the rotation of the drive shaft 62. The first power transmission portion 68 transmits the power to the feeding roller 63 according to the power from the driving portion 65. That is, the first power transmission portion 68 can transmit the power from the driving portion 65 to the feeding roller 63.

The first power transmission portion 68 includes a plurality of gears 70 to 75 and 77 to 79. That is, the power transmission portion 66 includes a plurality of gears 70 to 75 and 77 to 79. The first power transmission portion 68 includes a first rotating shaft 63A. The first power transmission portion 68 includes a second rotating shaft 76. Each of the plurality of gears 70 to 75 and 77 to 79 is pivotally attached to the arm portion 64 to be rotatable about an axis extending along the width direction X. Each of the plurality of gears 70 to 75 and 77 to 79 meshes with each other in order.

Each of the gears 70, 72, and 74 rotates in the first rotation direction R1 when the forward rotation power of the driving portion 65 is transmitted. Each of the gears 71, 73, and 75 rotates in the second rotation direction R2 when the forward rotation power of the driving portion 65 is transmitted. Each of the gears 70, 72, and 74 rotates in the second rotation direction R2 when the reverse rotation power of the driving portion 65 is transmitted. Each of the gears 71, 73, and 75 rotates in the first rotation direction R1 when the reverse rotation power of the driving portion 65 is transmitted.

In particular, the gear 70 is provided at the most upstream position in the power path of the first power transmission portion 68 among the plurality of gears 70 to 75 and 77 to 79. The gear 70 is pivotally attached to the drive shaft 62. In this way, the gear 70 is a member to which the power from the driving portion 65 is transmitted by the rotation of the drive shaft 62.

The gear 75 is pivotally attached to the second rotating shaft 76. The gear 75 rotates the second rotating shaft 76 by rotation. The gear 75 transmits the reverse rotation power of the driving portion 65 to both the first power transmission portion 68 and the second power transmission portion 69 as power in the first rotation direction R1. Specifically, the gear 75 rotates in the same direction as the rotation direction of the feeding roller 63 when the medium placed on the medium placement portion 54 is fed by the feeding roller 63.

The gear 77 is pivotally attached to the second rotating shaft 76. In this way, the gear 77 is a member to which the power from the driving portion 65 is transmitted by the rotation of the second rotating shaft 76. The gear 77 includes a one-way clutch. The gear 77 itself may be a one-way clutch, or the gear 77 may be combined with a one-way clutch. That is, the first power transmission portion 68 includes a one-way clutch. The gear 77 is pivotally attached to the second rotating shaft 76. The gear 77 rotates in the second rotation direction R2 together with the second rotating shaft 76 when the second rotating shaft 76 rotates in the second rotation direction R2. When the second rotating shaft 76 rotates in the first rotation direction R1, the gear 77 idles and does not rotate.

The gear 79 is provided at the most downstream position in the power path of the first power transmission portion 68 among the plurality of gears 70 to 75 and 77 to 79. The gear 79 is pivotally attached to the first rotating shaft 63A. The gear 79 rotates the first rotating shaft 63A by rotation. The gear 79 transmits the power from the driving portion 65 to the first rotating shaft 63A. That is, the gear 79 transmits the power from the driving portion 65 to the feeding roller 63.

Each of the gears 77 and 79 rotates in the second rotation direction R2 when the forward rotation power of the driving portion 65 is transmitted. The gear 78 rotates in the first rotation direction R1 when the forward rotation power of the driving portion 65 is transmitted. The reverse rotation power of the driving portion 65 is not transmitted to the gear 77 and it does not rotate. Therefore, the reverse rotation power of the driving portion 65 is not transmitted to each of the gears 77 to 79.

In this way, the feeding roller 63 can feed the medium placed on the medium placement portion 54 by rotating in a state of contacting with the medium placed on the medium placement portion 54. In particular, the feeding roller 63 can feed the media placed on the medium placement portion 54 one by one. The feeding direction in which the feeding roller 63 feeds the medium may be the rear side Y2. That is, the feeding direction in which the feeding roller 63 feeds the medium may be a direction opposite to the pull-out direction, but may not be exactly opposite to the pull-out direction, and may be a direction including a component in the direction opposite to the pull-out direction.

In particular, the gear 77 transmits the forward rotation power from the driving portion 65 to the feeding roller 63, but does not transmit the reverse rotation power from the driving portion 65 to the feeding roller 63. Thereby, the feeding roller 63 feeds the medium placed on the medium placement portion 54 by using the forward rotation power from the driving portion 65. On the other hand, the reverse rotation power from the driving portion 65 is not transmitted downstream from the gear 77, and thus is not transmitted to the feeding roller 63. In this way, the second rotation direction R2 is the feeding direction of the feeding roller 63.

The second power transmission portion 69 is a transmission path used as a second transmission path. The second transmission path is a transmission path for transmitting the power from the driving portion 65 to the displacement portion 86, which will be described later. The second power transmission portion 69 is a transmission portion to which power from the driving portion 65 is transmitted by the rotation of the drive shaft 62. The second power transmission portion 69 transmits the power to the displacement portion 86 according to the power from the driving portion 65. That is, the second power transmission portion 69 can transmit the power from the driving portion 65 to the displacement portion 86.

The second power transmission portion 69 includes a torque limiter 80. That is, the power transmission portion 66 includes the torque limiter 80. The torque limiter 80 is provided at the most upstream position in the power path of the second power transmission portion 69. The torque limiter 80 is pivotally attached to the drive shaft 62. In this way, the torque limiter 80 is a member to which the power from the driving portion 65 is transmitted by the rotation of the drive shaft 62. That is, the torque limiter 80 is provided coaxially with the drive shaft 62.

The torque limiter 80 is configured to block transmission of power at a predetermined load. Therefore, the torque limiter 80 rotates together with the drive shaft 62 when the drive shaft 62 rotates when a predetermined load is not applied. When a load equal to or greater than a predetermined load is applied, the torque limiter 80 idles and does not rotate even when the drive shaft 62 rotates.

The second power transmission portion 69 includes a plurality of gears 81 to 83. The second power transmission portion 69 includes a rack 84. That is, the medium feeding apparatus 60 includes the rack 84. Each of the plurality of gears 81 to 83 is pivotally attached to the unit housing 87 to be rotatable about an axis extending along the width direction X. Note that each of the plurality of gears 81 to 83 may be pivotally attached to the displacement unit 67. Each of the plurality of gears 81 to 83 meshes with each other in order.

In particular, the gear 81 is coupled to the torque limiter 80. Therefore, when the torque limiter 80 rotates, the gear 81 rotates together with the torque limiter 80. That is, the gear 81 rotates when no predetermined load is applied, but does not rotate when a load equal to or greater than the predetermined load is applied. The gear 83 meshes with the rack 84. The gear 83 transmits the power from the driving portion 65 to the rack 84.

The rack 84 is movable along the front-rear direction Y. The rack 84 is movable in parallel. Specifically, the rack 84 is movable to the rear side Y2 toward the feeding roller 63 and the front side Y1 which is the opposite direction from the rear side Y2. The rear side Y2 corresponds to an example of a first movement direction, and the front side Y1 corresponds to an example of a second movement direction. The rack 84 meshes with the gear 83. The rack 84 moves the displacement portion 86 along the front-rear direction Y.

When no predetermined load is applied, each of the gears 81 and 83 rotates in the first rotation direction R1 when the forward rotation power of the driving portion 65 is transmitted. When no predetermined load is applied, the gear 82 rotates in the second rotation direction R2 when the forward rotation power of the driving portion 65 is transmitted. When no predetermined load is applied, each of the gears 81 and 83 rotates in the second rotation direction R2 when the reverse rotation power of the driving portion 65 is transmitted. When no predetermined load is applied, the gear 82 rotates in the first rotation direction R1 when the reverse rotation power of the driving portion 65 is transmitted. Each of the gears 81 to 83 does not rotate when a load equal to or greater than a predetermined load is applied.

When no predetermined load is applied, the rack 84 moves in parallel toward the front side Y1 when the forward rotation power of the driving portion 65 is transmitted and the gear 83 rotates in the first rotation direction R1. When no predetermined load is applied, the rack 84 moves in parallel toward the rear side Y2 when the reverse rotation power of the driving portion 65 is transmitted and the gear 83 rotates in the second rotation direction R2. The rack 84 does not move in parallel when a load equal to or greater than a predetermined load is applied.

In this way, the torque limiter 80 transmits the power from the driving portion 65 to the displacement portion 86 when no predetermined load is applied, but does not transmit the power from the driving portion 65 to the displacement portion 86 when a load equal to or greater than the predetermined load is applied.

Configuration of Displacement Portion 86

Figure 8:
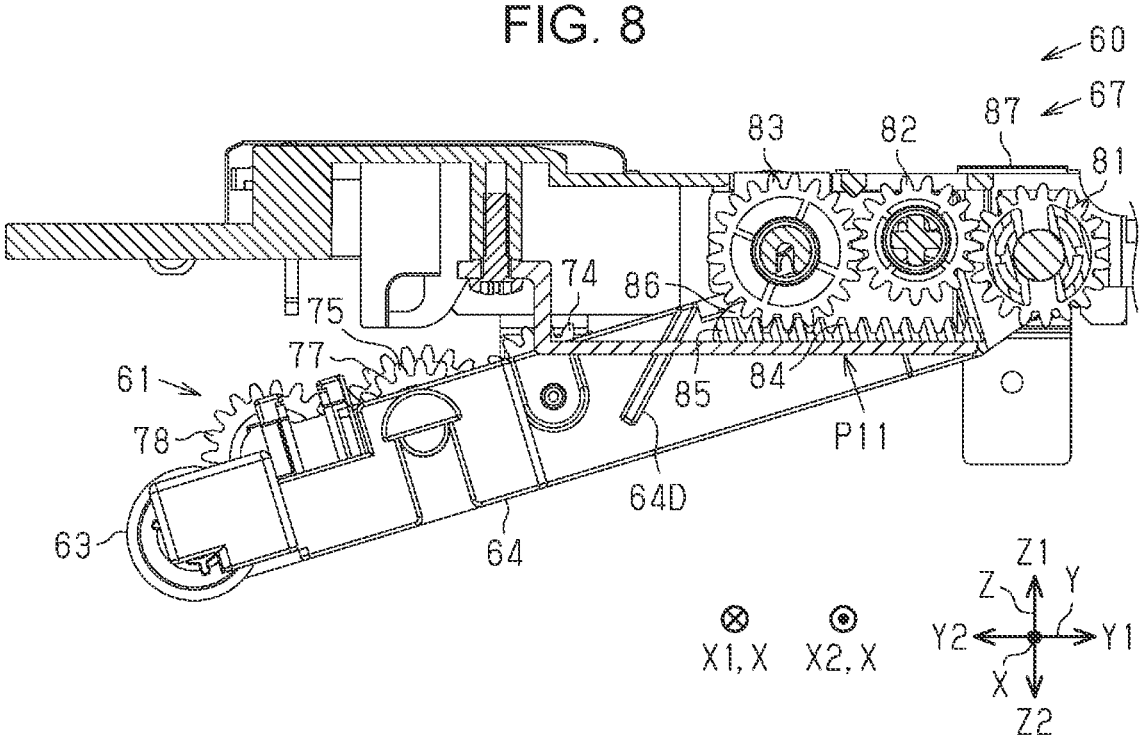
FIG. 8 is a side view showing the medium feeding apparatus according to the first embodiment.
Figure 9:
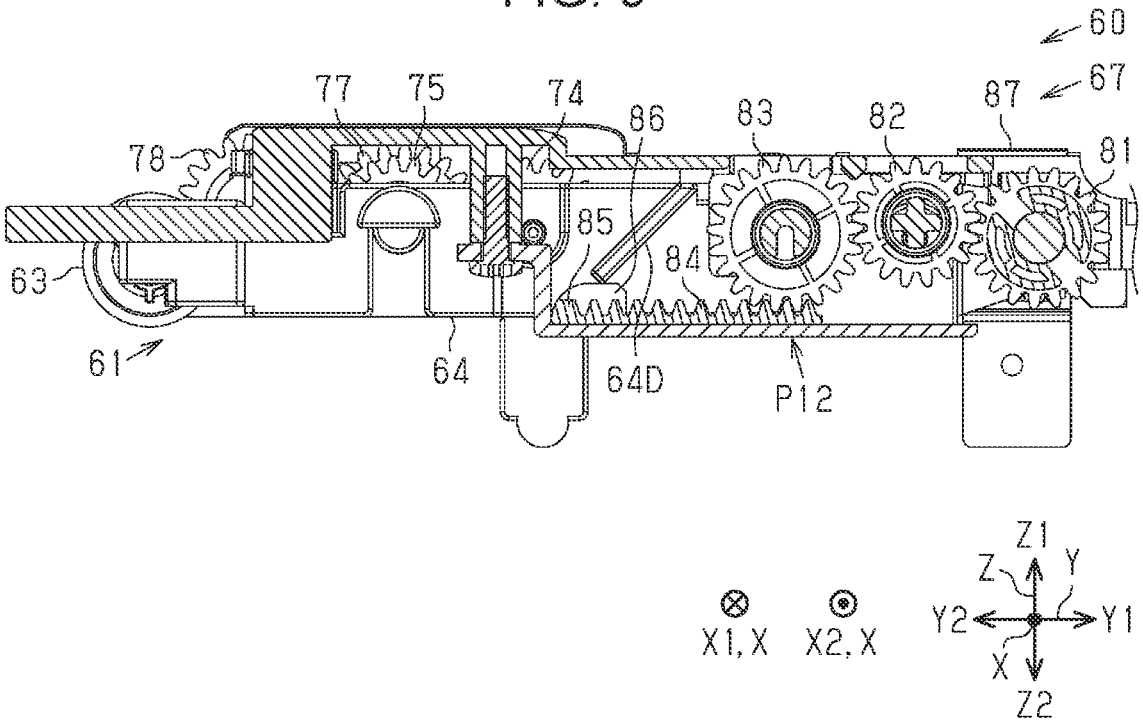
FIG. 9 is a side view showing the medium feeding apparatus according to the first embodiment.

As shown in FIGS. 5, 8, and 9, the medium feeding apparatus 60 includes a displacement portion 86. The displacement portion 86 is accommodated in the unit housing 87. The displacement portion 86 is configured integrally with the rack 84. The displacement portion 86 is provided on the rear side Y2 of the rack 84 and on the first width direction X1 side of the rack 84. The displacement portion 86 may be a protrusion that protrudes to the upper side Z1. In this way, the displacement portion 86 is provided on the rack 84.

The displacement portion 86 can be displaced between a first position P11 and a second position P12. In particular, the displacement portion 86 can be displaced between the first position P11 and the second position P12 by parallel movement of the rack 84. The displacement portion 86 can be displaced between the first position P11 and the second position P12 by using the power from the driving portion 65.

As shown in FIG. 8, the first position P11 is a position where the displacement portion 86 does not come into contact with the arm portion 64. Specifically, the first position P11 is a position where the displacement portion 86 does not come into contact with an inclined surface 64D provided on the arm portion 64. The first position P11 is a position where the displacement portion 86 is disposed on the front side Y1 with respect to the lower side Z2 of the inclined surface 64D.

The arm portion 64 includes the inclined surface 64D. The inclined surface 64D is provided on the second width direction X2 side of the arm portion 64. When the displacement portion 86 does not come into contact with the inclined surface 64D, the arm portion 64 rotates about the drive shaft 62 so that the tip portion 64B is directed to the lower side Z2 due to the own weight of the arm portion 64. Thereby, the feeding roller 63 comes into contact with the medium placed on the medium placement portion 54. That is, the first position P11 is a position where the feeding roller 63 is displaced to the contact position due to non-contact with the arm portion 64.

The displacement portion 86 is displaced from the second position P12 to the first position P11 by the rack 84 moving to the front side Y1 in parallel due to the forward rotation power from the driving portion 65. That is, the displacement portion 86 displaces the feeding roller 63 to the contact position by using the forward rotation power from the driving portion 65.

As shown in FIG. 9, the second position P12 is a position where the displacement portion 86 comes into contact with the arm portion 64. Specifically, the second position P12 is a position where the displacement portion 86 comes into contact with the inclined surface 64D from the lower side Z2. The second position P12 is a position where the displacement portion 86 is disposed on the lower side Z2 of the inclined surface 64D. In this way, the displacement portion 86 supports the arm portion 64 from the lower side Z2 at the second position P12.

When the displacement portion 86 comes into contact with the inclined surface 64D, the arm portion 64 rotates about the drive shaft 62 so that the tip portion 64B is directed to the upper side Z1 against the own weight of the arm portion 64. Thereby, the feeding roller 63 is separated from the medium placed on the medium placement portion 54 and does not come into contact with the medium placed on the medium placement portion 54. That is, the second position P12 is a position where the feeding roller 63 is displaced to the separation position due to contact with the arm portion 64.

The displacement portion 86 is displaced from the first position P11 to the second position P12 by the rack 84 moving to the rear side Y2 in parallel due to the reverse rotation power from the driving portion 65. That is, the displacement portion 86 displaces the feeding roller 63 to the separation position by using the reverse rotation power from the driving portion 65.

In this way, the displacement portion 86 can come into contact with the arm portion 64, and rotates the arm portion 64 by using the forward rotation power from the driving portion 65. Thereby, the arm portion 64 displaces the feeding roller 63 between the contact position and the separation position.

In particular, the displacement portion 86 rotates the arm portion 64 to displace the feeding roller 63 from the separation position to the contact position by using the forward rotation power from the driving portion 65. The displacement portion 86 rotates the arm portion 64 to displace the feeding roller 63 from the contact position to the separation position by using the reverse rotation power from the driving portion 65. That is, the displacement portion 86 displaces the feeding roller 63 between the contact position and the separation position by displacing between the first position P11 and the second position P12. Further, when the displacement portion 86 is displaced from the second position P12 to the first position P11, depending on the medium placed on the medium placement portion 54, the feeding roller 63 may come into contact with the medium before the displacement portion 86 is disposed at the first position P11.

As shown in FIGS. 8 and 9, when the displacement portion 86 is disposed at the first position P11, the rack 84 is located on the most front side Y1. When the displacement portion 86 is disposed at the first position P11, the rack 84 is located on the rear side Y2 with respect to the drive shaft 62 and does not protrude to the front side Y1 from the drive shaft 62.

The direction in which the displacement portion 86 is displaced from the second position P12 to the first position P11 is the same direction as the direction along the pull-out direction in which the medium placement portion 54 is pulled out. However, the direction does not have to be strictly the same direction as the direction along the pull-out direction, but may be a direction including a component in the same direction as the direction along the pull-out direction.

Displacement of Rack 84

Figure 10:
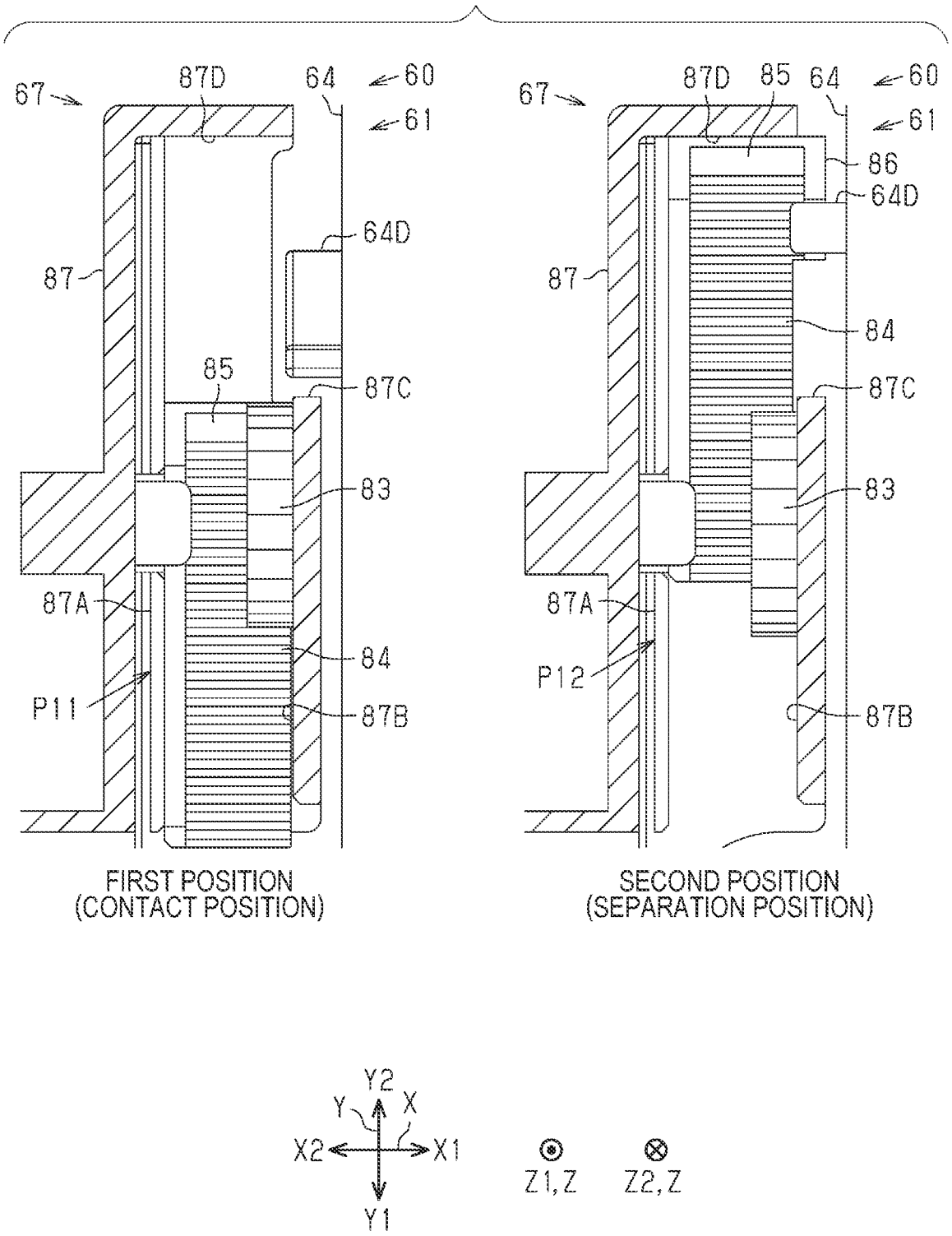
FIG. 10 is a top view showing the medium feeding apparatus according to the first embodiment.

As shown in FIG. 10, the medium feeding apparatus 60 includes a first restricting portion 85. The first restricting portion 85 is accommodated in the unit housing 87. The first restricting portion 85 is configured integrally with the rack 84. The first restricting portion 85 is provided on the rear side Y2 of the rack 84. The first restricting portion 85 may be a protruding portion that protrudes to the upper side Z1. The first restricting portion 85 may be a protruding portion that protrudes to the upper side Z1 with respect to the rack 84. The first restricting portion 85 applies a load equal to or greater than a predetermined load to the gear 83 in a state of being meshed with the gear 83. Thereby, the first restricting portion 85 restricts the displacement of the rack 84 to the front side Y1 when the rack 84 is disposed so that the displacement portion 86 is at the first position P11.

In this way, the first restricting portion 85 restricts the displacement of the displacement portion 86 at the first position P11 when the displacement portion 86 is displaced from the second position P12 to the first position P11. In such a case, when the displacement of the displacement portion 86 is restricted by the first restricting portion 85 at the first position P11, the torque limiter 80 blocks the transmission of power to the displacement portion 86 at a predetermined load.

The unit housing 87 includes a first guide portion 87A. The first guide portion 87A is provided on the second width direction X2 side with respect to the rack 84. The first guide portion 87A is a protruding portion that protrudes to the upper side Z1. The first guide portion 87A extends along the front-rear direction Y. The first guide portion 87A guides the displacement of the rack 84 in the front-rear direction Y on the second width direction X2 side of the rack 84.

The unit housing 87 includes a second guide portion 87B. The second guide portion 87B is provided on the first width direction X1 side with respect to the rack 84. The second guide portion 87B is a protruding portion that protrudes to the upper side Z1. The second guide portion 87B extends along the front-rear direction Y. The second guide portion 87B guides the displacement of the rack 84 in the front-rear direction Y on the first width direction X1 side of the rack 84.

The unit housing 87 includes a notch 87C. The notch 87C is provided on the rear side Y2 with respect to the second guide portion 87B. The notch 87C constitutes a part of a movement area of the displacement portion 86. The notch 87C constitutes a part of a movement area of the inclined surface 64D. The notch 87C forms a space in which the displacement portion 86 can come into contact with the inclined surface 64D.

The unit housing 87 includes a second restricting portion 87D. That is, the medium feeding apparatus 60 includes the second restricting portion 87D. The second restricting portion 87D is provided on the rear side Y2 with respect to the first guide portion 87A. The second restricting portion 87D may be a protruding portion that protrudes to the upper side Z1.

The second restricting portion 87D comes into contact with the first restricting portion 85 due to the displacement of the rack 84 to the rear side Y2. The second restricting portion 87D applies a load equal to or greater than a predetermined load to the gear 83 by coming into contact with the first restricting portion 85. Thereby, the first restricting portion 85 restricts the displacement of the rack 84 to the rear side Y2 when the rack 84 is disposed so that the displacement portion 86 is at the second position P12.

In this way, the second restricting portion 87D restricts the displacement of the displacement portion 86 at the second position P12 when the displacement portion 86 is displaced from the first position P11 to the second position P12. In such a case, when the displacement of the displacement portion 86 is restricted by the second restricting portion 87D at the second position P12, the torque limiter 80 blocks the transmission of the power to the displacement portion 86 at a predetermined load. The first restricting portion 85 and the second restricting portion 87D correspond to an example of a restricting portion.

Note that the rack 84 is provided at a position that takes into account the inclination angle of the arm portion 64. The rack 84 is disposed on the upper side Z1 from a height in consideration of a height of the media when the number of media placed on the medium placement portion 54 is the maximum and a gap of the upper side Z1 of the media.

The arm portion 64 needs to rotate at an inclination angle at which the medium placed on the medium placement portion 54 and the feeding roller 63 can come into contact with each other. Therefore, the arm portion 64 has to be rotatable at an inclination angle according to the medium placed on the medium placement portion 54. As a specific example, the arm portion 64 needs to rotate at an inclination angle at which the medium and the feeding roller 63 can come into contact with each other both when the number of media placed on the medium placement portion 54 is the minimum and when the number of media is the maximum.

The arm portion 64 has a larger moment toward the lower side Z2 at a position farther from the supported drive shaft 62 than at a position closer to it. For this reason, it is desirable that the rack 84 is farther away from the drive shaft 62. In this way, assuming that the conditions for the height of the rack 84 and the inclination angle of the arm portion 64 are satisfied, the rack 84 is disposed far from the drive shaft 62.

Also, the predetermined load of the torque limiter 80 is set so that the rack 84 can be displaced from the first position P11 to the second position P12 against the weight of the arm portion 64 and the biasing force of the arm portion 64 toward the lower side Z2.

Contact Process

Here, a contact process will be described with reference to FIG. 11. The contact process is a process executed by the control portion 23 at predetermined intervals.

Figure 11:
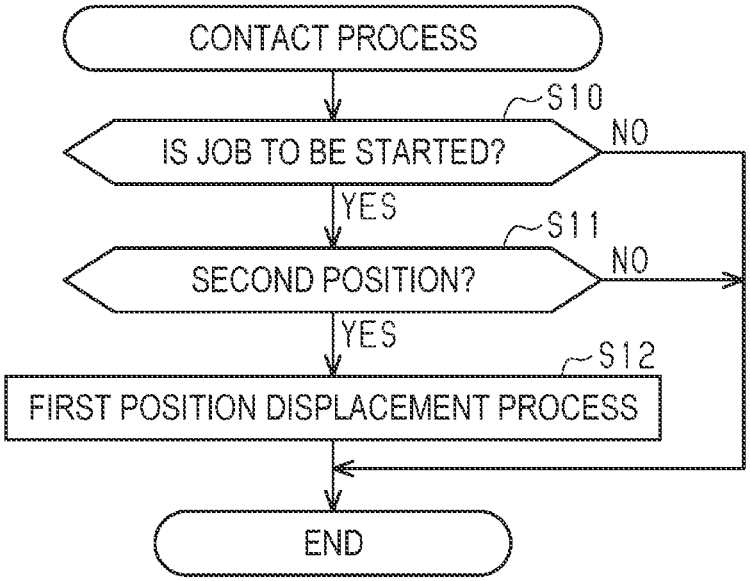
FIG. 11 is a flowchart showing a contact process of the first embodiment.

As shown in FIG. 11, in step S10, the control portion 23 determines whether or not a job is to be started based on an instruction from the user. The job is a process of performing recording on a medium. The job may be a process of performing recording on one or a plurality of media. When the control portion 23 determines that the job is not started, the control portion 23 ends the contact process without executing steps S11 and S12. When the control portion 23 determines that the job is to be started, the process proceeds to step S11.

In step S11, the control portion 23 determines whether or not the displacement portion 86 is at the second position P12. That is, the control portion 23 determines whether or not the feeding roller 63 is at the separation position. The control portion 23 determines whether or not the displacement portion 86 is at the second position P12 based on position information assigned to the memory. The position information is information indicating the position of the displacement portion 86. The position information is stored in the memory by the control portion 23 as the displacement portion 86 is displaced. When the control portion 23 determines that the displacement portion 86 is not at the second position P12, the control portion 23 ends the contact process without executing step S12. That is, when the control portion 23 determines that the displacement portion 86 is at the first position P11, the control portion 23 ends the contact process without executing step S12. When the control portion 23 determines that the displacement portion 86 is at the second position P12, the process proceeds to step S12.

In step S12, the control portion 23 executes a first position displacement process. In the first position displacement process, the control portion 23 drives the driving portion 65 to be rotated in the forward direction. Thereby, the displacement portion 86 is displaced from the second position P12 to the first position P11. The feeding roller 63 is displaced from the separation position to the contact position. In this way, when the job of performing recording on the medium starts, the control portion 23 displaces the displacement portion 86 to the second position P12. Then, the control portion 23 stores position information indicating the first position P11 in the memory. When the first position displacement process is ended, the control portion 23 ends the contact process.

After the contact process is ended, the control portion 23 executes the feeding process by continuously driving the driving portion 65 to be rotated in the forward direction. Therefore, the time until the feeding process is executed differs between when the displacement portion 86 is at the first position P11 and when the displacement portion 86 is displaced from the second position P12 to the first position P11. Specifically, the time until the feeding process is executed is longer when the displacement portion 86 is displaced from the second position P12 to the first position P11 than when the displacement portion 86 is at the first position P11. Note that the contact process and the feeding process may not be clearly distinguished during control and may be continuously executed as one process.

First Separation Process

Next, a first separation process will be described with reference to FIG. 12. The first separation process is a process executed by the control portion 23 at predetermined intervals.

Figure 12:
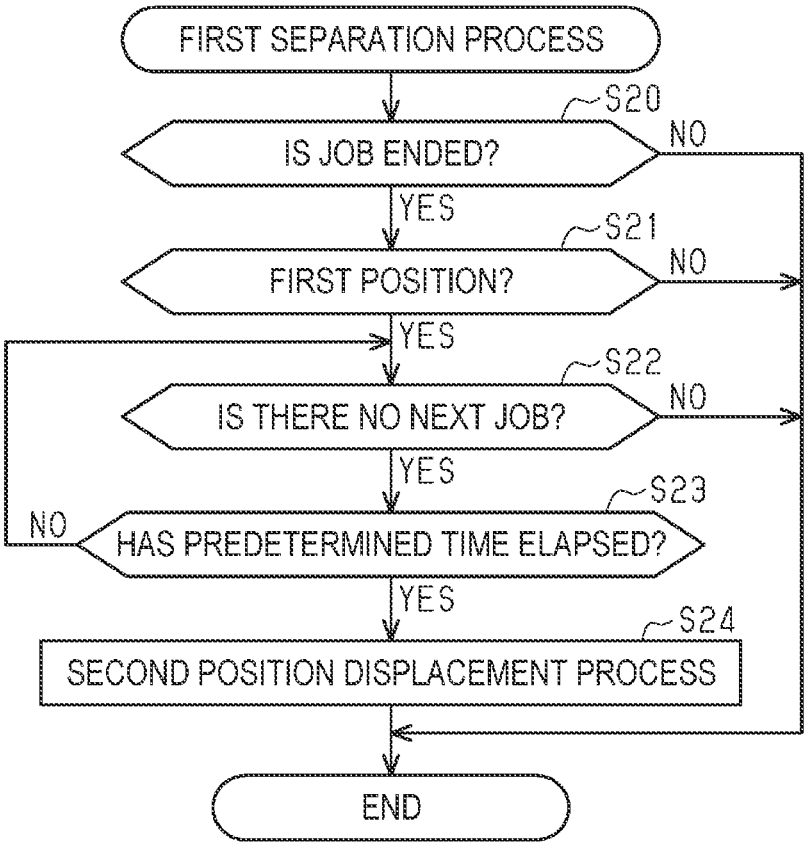
FIG. 12 is a flowchart showing a first separation process of the first embodiment.

As shown in FIG. 12, in step S20, the control portion 23 determines whether or not the job is ended. When the control portion 23 determines that the job is not ended, the control portion 23 ends the first separation process without executing steps S21 to S24. When the control portion 23 determines that the job is ended, the process proceeds to step S21.

In step S21, the control portion 23 determines whether or not the displacement portion 86 is at the first position P11. That is, the control portion 23 determines whether or not the feeding roller 63 is at the contact position. The control portion 23 determines whether or not the displacement portion 86 is at the first position P11 based on position information assigned to the memory. When the control portion 23 determines that the displacement portion 86 is not at the first position P11, the control portion 23 ends the first separation process without executing steps S22 to S24. That is, when the control portion 23 determines that the displacement portion 86 is at the second position P12, the control portion 23 ends the first separation process without executing steps S22 to S24. When the control portion 23 determines that the displacement portion 86 is at the first position P11, the process proceeds to step S22.

In step S22, the control portion 23 determines whether or not there is no next job. That is, the control portion 23 determines whether or not there is no next job after the job ends. When the control portion 23 determines that there is a next job, the control portion 23 ends the first separation process without executing steps S23 and S24. When the control portion 23 determines that there is no next job, the process proceeds to step S23.

In step S23, the control portion 23 determines whether or not a predetermined time has elapsed. The control portion 23 measures the time that has elapsed after it was determined that the job is ended. The control portion 23 determines whether or not a predetermined time has elapsed depending on whether or not the time that has elapsed after it was determined that the job has been ended has reached a predetermined time. When the control portion 23 determines that the predetermined time has not elapsed, the process proceeds to step S22 again. When the control portion 23 determines that the predetermined time has elapsed, the process proceeds to step S24. In this way, when the control portion 23 determines that there is a next job before the predetermined time has elapsed after the end of the job, the control portion 23 ends the first separation process without executing step S24. When the control portion 23 determines that there is no next job for a predetermined time after the end of the job, the process proceeds to step S24.

In step S24, the control portion 23 executes a second position displacement process. In the second position displacement process, the control portion 23 drives the driving portion 65 to be rotated in the reverse direction. Thereby, the displacement portion 86 is displaced from the first position P11 to the second position P12. In this way, the control portion 23 displaces the displacement portion 86 to the second position P12 when there is no next job for a predetermined time after the job of performing recording on the medium is ended. The feeding roller 63 is displaced from the contact position to the separation position. Then, the control portion 23 stores position information indicating the second position P12 in the memory. When the second position displacement process is ended, the control portion 23 ends the first separation process.

Second Separation Process

Next, a second separation process will be described with reference to FIG. 13. The second separation process is a process executed by the control portion 23 at predetermined intervals.

Figure 13:
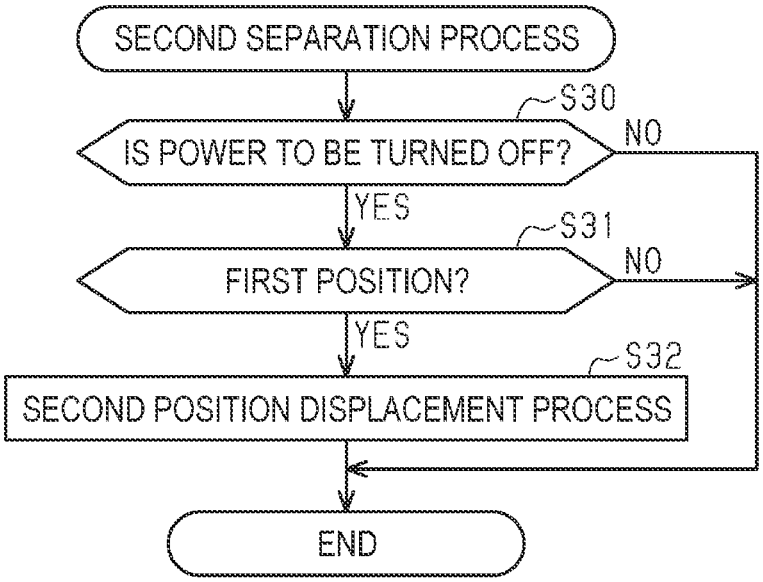
FIG. 13 is a flowchart showing a second separation process of the first embodiment.

As shown in FIG. 13, in step S30, the control portion 23 determines whether or not the power is to be turned off. The power supply may be turned off according to an instruction of the user, but may be turned off by power-off. In this case, the second separation process may be executed based on the backup power supply. When the control portion 23 determines that the power will not be turned off, the control portion 23 ends the second separation process without executing steps S31 and S32. When the control portion 23 determines that the power will be turned off, the process proceeds to step S31.

In step S31, the control portion 23 determines whether or not the displacement portion 86 is at the first position P11, as in step S21. When the control portion 23 determines that the displacement portion 86 is not at the first position P11, the control portion 23 ends the second separation process without executing step S32. That is, when the control portion 23 determines that the displacement portion 86 is at the second position P12, the control portion 23 ends the second separation process without executing step S32. When the control portion 23 determines that the displacement portion 86 is at the first position P11, the process proceeds to step S32.

In step S32, the control portion 23 executes a second position displacement process, as in step S24. In the second position displacement process, the control portion 23 drives the driving portion 65 to be rotated in the reverse direction. Thereby, the displacement portion 86 is displaced from the first position P11 to the second position P12. In this way, the control portion 23 displaces the displacement portion 86 to the second position P12 when turning off the power. The feeding roller 63 is displaced from the contact position to the separation position. Then, the control portion 23 stores position information indicating the second position P12 in the memory. When the second position displacement process is ended, the control portion 23 ends the second separation process.

Medium Feeding Monitoring Process

Next, a medium feeding monitoring process will be described with reference to FIG. 14. The medium feeding monitoring process is a process executed by the control portion 23 at predetermined intervals.

Figure 14:
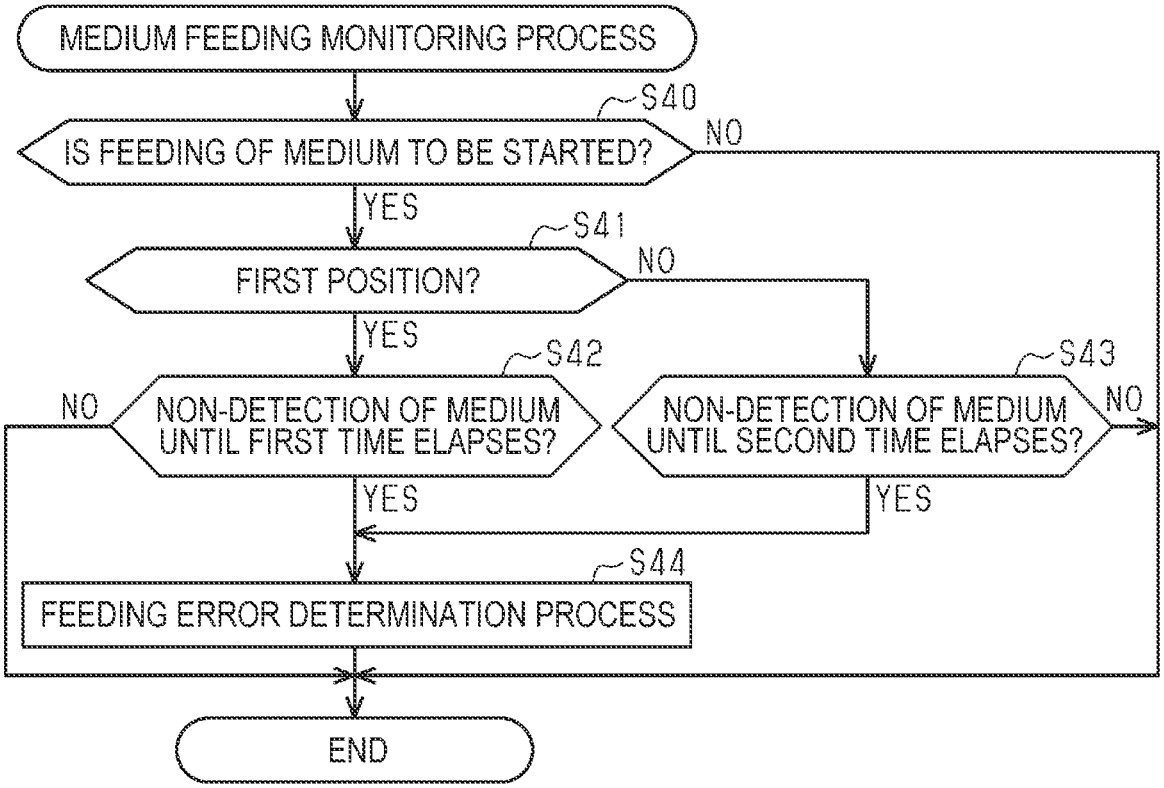
FIG. 14 is a flowchart showing a medium feeding monitoring process of the first embodiment.

As shown in FIG. 14, in step S40, the control portion 23 determines whether or not the feeding roller 63 starts feeding the medium. When the control portion 23 determines that the feeding of the medium is not started, the control portion 23 ends the medium feeding monitoring process without executing steps S41 to S44. When the control portion 23 determines that the feeding of the medium is to be started, the process proceeds to step S41.

In step S41, the control portion 23 determines whether or not the displacement portion 86 is at the first position P11, as in steps S21 and S31. When the control portion 23 determines that the displacement portion 86 is at the first position P11, the process proceeds to step S42. That is, when the displacement portion 86 is already at the first position P11 in both when the job is started and when the job is not started, the control portion 23 proceeds the process to step S42. When the control portion 23 determines that the displacement portion 86 is not at the first position P11, the process proceeds to step S43. That is, when the displacement portion 86 is at the second position P12 when the job is started, the control portion 23 proceeds the process to step S43.

In step S42, the control portion 23 determines whether or not the tip of the medium has not been detected, based on a result of detection performed by the medium detection portion 59, until a first time elapses after the driving portion 65 is driven to be rotated in the forward direction. The first time is a reference time for determining a feeding error. The reference time for determining a feeding error is the time starting from the forward rotation drive of the driving portion 65. When the control portion 23 determines that the tip of the medium has been detected until the first time elapses after the driving portion 65 is driven to be rotated in the forward direction, the control portion 23 ends the medium feeding monitoring process without executing step S44. When the control portion 23 determines that the tip of the medium has not been detected until the first time elapses after the driving portion 65 is driven to be rotated in the forward direction, the control portion 23 proceeds the process to step S44.

In step S43, the control portion 23 determines whether or not the tip of the medium has not been detected, based on a result of detection performed by the medium detection portion 59, until a second time elapses after the driving portion 65 is driven to be rotated in the forward direction. The second time is a reference time for determining a feeding error. The second time is longer than the first time. The second time is longer than the first time by the estimated time for displacing the displacement portion 86 from the second position P12 to the first position P11. When the control portion 23 determines that the tip of the medium has been detected until the second time elapses after the driving portion 65 is driven to be rotated in the forward direction, the control portion 23 ends the medium feeding monitoring process without executing step S44. When the control portion 23 determines that the tip of the medium has not been detected until the second time elapses after the driving portion 65 is driven to be rotated in the forward direction, the control portion 23 proceeds the process to step S44.

In step S44, the control portion 23 executes a feeding error determination process. In the feeding error determination process, the control portion 23 determines that a feeding error has occurred. In this case, the control portion 23 causes the display portion 35 to display an image indicating the occurrence of the feeding error. The control portion 23 may end the feeding process. When the feeding error determination process is ended, the control portion 23 ends the medium feeding monitoring process.

In this way, when the displacement portion 86 is at the first position P11, the control portion 23 determines that a feeding error has occurred when the tip of the medium is not detected by the medium detection portion 59 even when a first time has elapsed after the driving of the driving portion 65 was started to feed the medium. When the displacement portion 86 is at the second position P12, the control portion 23 determines that a feeding error has occurred when the tip of the medium is not detected by the medium detection portion 59 even when a second time, which is longer than the first time, has elapsed after the driving of the driving portion 65 was started to feed the medium.

When the control portion 23 determines that the displacement portion 86 is already at the first position P11, the control portion 23 starts feeding the medium without a time for displacing the displacement portion 86 from the second position P12 to the first position P11. When the control portion 23 determines that the displacement portion 86 is at the second position P12 in step S41, the control portion 23 starts feeding the medium after a time during which the displacement portion 86 is displaced from the second position P12 to the first position P11. Accordingly, when it is determined that the displacement portion 86 is at the second position P12 rather than when it is determined that the displacement portion 86 is already at the first position P11, starting from the forward rotation drive of the driving portion 65, the reference time for determining a feeding error becomes longer.

Attachment/Detachment Control Process

Next, an attachment/detachment control process will be described with reference to FIG. 15. The attachment/detachment control process is a process executed by the control portion 23 at predetermined intervals.

Figure 15:
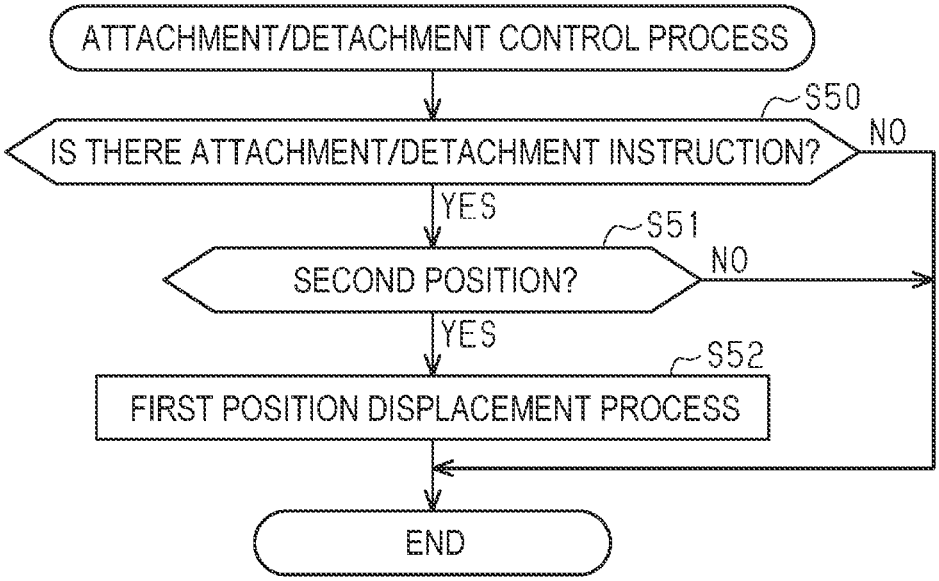
FIG. 15 is a flowchart showing an attachment/detachment control process of the first embodiment.

As shown in FIG. 15, in step S50, the control portion 23 determines whether or not there is an attachment/detachment instruction from the user. The attachment/detachment instruction is given according to an operation of the operation portion 34. When the control portion 23 determines that there is no attachment/detachment instruction, the control portion 23 ends the attachment/detachment control process without executing steps S51 and S52. When the control portion 23 determines that there is an attachment/detachment instruction, the process proceeds to step S51.

In step S51, the control portion 23 determines whether or not the displacement portion 86 is at the second position P12, as in step S11. When the control portion 23 determines that the displacement portion 86 is not at the second position P12, the control portion 23 ends the attachment/detachment control process without executing step S52. When the control portion 23 determines that the displacement portion 86 is at the second position P12, the process proceeds to step S52.

In step S52, the control portion 23 executes the first position displacement process, as in step S12. In the first position displacement process, the control portion 23 drives the driving portion 65 to be rotated in the forward direction. Thereby, the displacement portion 86 is displaced from the second position P12 to the first position P11. In this way, when the displacement portion 86 is at the second position P12, the control portion 23 displaces the displacement portion 86 from the second position P12 to the first position P11 when the arm portion 64 is attached to and detached from the drive shaft 62. The feeding roller 63 is displaced from the separation position to the contact position. Then, the control portion 23 stores position information indicating the first position P11 in the memory. When the first position displacement process is ended, the control portion 23 ends the attachment/detachment control process.

Operation and Effects of First Embodiment

The operation and effects of the first embodiment will be described.

(1-1) The feeding roller 63 feeds the medium placed on the medium placement portion 54 by using the forward rotation power from the driving portion 65. The arm portion 64 displaces the feeding roller 63 between a contact position that comes into contact with the medium placed on the medium placement portion 54 and a separation position that is separated from the medium placed on the medium placement portion 54. The displacement portion 86 rotates the arm portion 64 to displace the feeding roller 63 from the separation position to the contact position by using the forward rotation power from the driving portion 65. The displacement portion 86 rotates the arm portion 64 to displace the feeding roller 63 from the contact position to the separation position by using the reverse rotation power from the driving portion 65. According to this configuration, the driving of the feeding roller 63 and the displacement portion 86 that displaces the arm portion 64 that supports the feeding roller 63 can be implemented using power from the common driving portion 65. Therefore, it is possible to suppress bleed marks caused by the feeding roller 63, and it is also possible to suppress the increase in size of the apparatus.

(1-2) The displacement portion 86 can be displaced between a first position P11 and a second position P12. The first position P11 is a position where the feeding roller 63 is displaced to the contact position due to non-contact with the arm portion 64. The second position P12 is a position where the feeding roller 63 is displaced to the separation position due to contact with the arm portion 64. According to this configuration, with a simple configuration that switches between non-contact and contact between the displacement portion 86 and the arm portion 64, the feeding roller 63 can be displaced to the contact position and the separation position by using the power from the common driving portion 65. Therefore, it is possible to suppress bleed marks caused by the feeding roller 63, and it is also possible to suppress the increase in size of the apparatus.

(1-3) The displacement portion 86 supports the arm portion 64 from the lower side Z2 at the second position P12. According to this configuration, with a simple configuration that switches whether or not to support the displacement portion 86 and the arm portion 64 from the lower side Z2, the feeding roller 63 can be displaced to the contact position and the separation position by using the power from the common driving portion 65. Therefore, it is possible to suppress bleed marks caused by the feeding roller 63, and it is also possible to suppress the increase in size of the apparatus.

(1-4) The displacement portion 86 is provided in the rack 84 that is movable in parallel. According to this configuration, with a simple configuration in which the displacement portion 86 is provided in the rack 84 that is movable in parallel, the feeding roller 63 can be displaced to the contact position and the separation position by using the power from the common driving portion 65. Therefore, it is possible to suppress bleed marks caused by the feeding roller 63, and it is also possible to suppress the increase in size of the apparatus.

(1-5) The rack 84 is movable in the front-rear direction Y and the displacement portion 86 is disposed at the first position P11, the rack 84 is located on the rear side Y2 toward the feeding roller 63 with respect to the drive shaft 62 and does not protrude to the front side Y1 from the drive shaft 62. According to this configuration, the rack 84 can be positioned on the rear side Y2 toward the feeding roller 63 with respect to the drive shaft 62. Thereby, even when the arm portion 64 and the rack 84 are at the farthest position, it is possible to suppress the displacement of the arm portion 64 from interfering with the drive shaft 62.

(1-6) The feeding roller 63 feeds the medium placed on the medium placement portion 54 by using the forward rotation power from the driving portion 65. The displacement portion 86 displaces the feeding roller 63 to the contact position by using the forward rotation power from the driving portion 65, and displaces the feeding roller 63 to the separation position by using the reverse rotation power from the driving portion 65. The power transmission portion 66 includes a gear 77 that is a one-way clutch that transmits the forward rotation power from the driving portion 65 to the feeding roller 63, but that does not transmit the reverse rotation power from the driving portion 65 to the feeding roller 63. According to this configuration, the displacement portion 86 can displace the feeding roller 63 to the separation position by using the reverse rotation power from the driving portion 65 without the gear 77 transmitting the reverse rotation power to the feeding roller 63. Thereby, the feeding roller 63 can be displaced to the separation position without rotating the feeding roller 63. Therefore, it is possible to suppress bleed marks caused by the feeding roller 63, and it is possible to improve the alignment of the medium in contact with the feeding roller 63.

(1-7) The displacement portion 86 can be displaced between a first position P11 and a second position P12. The first position P11 is a position where the feeding roller 63 is displaced to the contact position, and the second position P12 is a position where the feeding roller 63 is displaced to the separation position. The first restricting portion 85 restricts the displacement of the displacement portion 86 at the first position P11 when the displacement portion 86 is displaced from the second position P12 to the first position P11. The second restricting portion 87D restricts the displacement of the displacement portion 86 at the second position P12 when the displacement portion 86 is displaced from the first position P11 to the second position P12. The second power transmission portion 69 includes a torque limiter 80 that transmits the power from the driving portion 65 to the displacement portion 86 and blocks the transmission of the power at a predetermined load. When the displacement of the displacement portion 86 is restricted by the first restricting portion 85 at the first position P11, the torque limiter 80 blocks the transmission of the power to the displacement portion 86. When the displacement of the displacement portion 86 is restricted by the second restricting portion 87D at the second position P12, the torque limiter 80 blocks the transmission of the power to the displacement portion 86. According to this configuration, when the displacement of the displacement portion 86 is restricted by the first restricting portion 85 at the first position P11, a load equal to or greater than a predetermined load is applied to the torque limiter 80, and thereby the torque limiter 80 blocks the transmission of power to the displacement portion 86. When the displacement of the displacement portion 86 is restricted by the second restricting portion 87D at the second position P12, a load equal to or greater than a predetermined load is applied to the torque limiter 80, and thereby the torque limiter 80 blocks the transmission of power to the displacement portion 86. In this way, by providing the torque limiter 80, it is possible to suppress the load on the driving portion 65 when driving the feeding roller 63.

In particular, by providing the torque limiter 80 in the second power transmission portion 69 different from the power transmission path to the feeding roller 63, the torque limiter 80 can be provided further upstream. Therefore, it is possible to suppress the load on the driving portion 65 when driving the feeding roller 63, and it is also possible to shorten the power transmission path between the torque limiter 80 and the displacement portion 86. Furthermore, the displacement portion 86 can be accurately displaced to the second position P12 without providing a detection portion that detects displacement of the displacement portion 86 to the second position P12. Therefore, it is possible to improve the alignment of the medium in contact with the feeding roller 63.

(1-8) The torque limiter 80 is provided coaxially with the drive shaft 62. According to this configuration, the weight of the arm portion 64 can be reduced as compared with a configuration in which the torque limiter 80 is provided in the arm portion. Accordingly, it is possible to suppress the influence on the transport force of the feeding roller 63 supported by the arm portion 64. Moreover, the increase in size of the apparatus can be suppressed as compared with a configuration in which the torque limiter 80 is provided upstream of the drive shaft 62.

(1-9) The arm portion 64 swingably supports the feeding roller 63. According to this configuration, vibration of the feeding roller 63 can be suppressed. In particular, in the related art, when the feeding roller and the displacement portion were directly linked, it was not easy to swingably support the feeding roller. Therefore, by providing the torque limiter 80 in the second power transmission portion 69 different from the feeding roller 63, the feeding roller 63 can be supported swingably.

(1-10) The arm portion 64 is rotatable to change the distance between the feeding roller 63 and the medium placement portion 54. According to this configuration, by rotating the arm portion 64, the distance between the feeding roller 63 and the medium placed on the medium placement portion 54 can be changed. Therefore, the arm portion 64 rotates according to the thickness and the number of media placed on the medium placement portion 54, and accordingly, the media placed on the medium placement portion 54 can be varied. Therefore, user convenience can be improved.

(1-11) The drive shaft 62 rotatably supports the arm portion 64, and the arm portion 64 is attachable to and detachable from the drive shaft 62. According to this configuration, by removing the arm portion 64 from the drive shaft 62, the feeding roller 63 can be easily replaced. In particular, when the displacement portion 86 and the power transmission portion 66 are accommodated in the arm portion 64, the displacement portion 86 and the power transmission portion 66 can be easily replaced together with the feeding roller 63. In other words, the configuration for driving the feeding roller 63 and the configuration for displacing the displacement portion 86 can be easily replaced.

(1-12) The arm retraction portion 30 retracts the arm portion 64 to the retracted position when pulling out the medium placement portion 54 in the pull-out direction. According to this configuration, it is possible to suppress the medium placement portion 54 from interfering with the arm portion 64 when the medium placement portion 54 is pulled out.

(1-13) The reversing portion 58 reverses the medium fed by the medium feeding apparatus 60. The recording portion 48 can perform recording on photo paper that can be double-sided printed as a medium, and can perform recording after the medium is reversed by the reversing portion 58. According to this configuration, it is possible to suppress bleed marks caused by the feeding roller 63 on photo paper that can be double-sided printed. Thereby, even more special effects can be achieved. Specifically, general photo paper is often printed on only one side. In this case, the surface that the feeding roller 63 comes into contact with is a surface opposite to the surface to be recorded, and bleed marks are less likely to be a problem. However, in the case of photo paper that is printed on both sides, the recording is also performed on the surface that the feeding roller 63 comes into contact with. Therefore, even more special effects can be achieved. Furthermore, when printing on photo paper, print quality may be more important than when printing on general paper. Therefore, by suppressing the bleed mark, even more special effects can be achieved. Note that photo paper is paper that is primarily used for printing photos and is suitable for printing photos. The fact that recording can be performed on photo paper indicates that the recording apparatus 11 supports printing on paper suitable for printing photos as described above.

(1-14) The control portion 23 displaces the displacement portion 86 to the second position P12 when there is no next job for a predetermined time after a job of performing recording on the medium is ended and when the power is turned off. According to this configuration, the feeding roller 63 can be displaced to the separation position when there is no next job for a predetermined time after the end of a job and when the power is turned off. Thereby, by displacing the feeding roller 63 to the separation position at an appropriate timing, it is possible to suppress bleed marks caused by the feeding roller 63.

(1-15) When the displacement portion 86 is at the first position P11, the control portion 23 determines that a feeding error has occurred when the tip of the medium is not detected by the medium detection portion 59 even when a first time has elapsed after the forward rotation drive of the driving portion 65 was started to feed the medium. When the displacement portion 86 is at the second position P12, the control portion 23 determines that a feeding error has occurred when the tip of the medium is not detected by the medium detection portion 59 even when a second time, which is longer than the first time, has elapsed after the forward rotation drive of the driving portion 65 was started to feed the medium. According to this configuration, when the medium is fed by the feeding roller 63, the feeding roller 63 comes into contact with the medium after a time during which the displacement portion 86 is displaced from the second position P12 to the first position P11 when the displacement portion 86 is at the second position P12 rather than when the displacement portion 86 is at the first position P11. Therefore, when the medium is fed by the feeding roller 63, the accuracy of determining a feeding error can be increased by lengthening the time that is the reference for determining a feeding error when the displacement portion 86 is at the second position P12 rather than when the displacement portion 86 is at the first position P11.

(1-16) When the displacement portion 86 is at the second position P12, the control portion 23 can displace the displacement portion 86 from the second position P12 to the first position P11 when the arm portion 64 is attached to and detached from the drive shaft 62. According to this configuration, by displacing the displacement portion 86 from the second position P12 to the first position P11, it is possible to suppress interference between the displacement portion 86 and the arm portion 64. Thereby, the arm portion 64 can be easily attached to and detached from the drive shaft 62. Therefore, user convenience can be improved.

(1-17) The main body 21 is configured to be held in a predetermined position with respect to the housing 20. The predetermined position includes a closed position, a first open position, and a second open position. The closed position is a position where the main body 21 is accommodated in the housing 20. The first open position is a position where the main body 21 protrudes from the housing 20 by a first distance D1 toward the front side Y1. The second open position is a position where the main body 21 protrudes from the housing 20 by a second distance D2, which is longer than the first distance D1, toward the front side Y1. The main body 21 is displaceable between a closed position, a first open position, and a second open position along the front-rear direction Y. Therefore, the main body 21 can be displaced between the closed position, the first open position, and the second open position along the front-rear direction Y, and the main body 21 can be held in the closed position, the first open position, and the second open position with respect to the housing 20. Therefore, it is possible to select the type of open position that can be held, and it is possible to improve the workability regarding the displacement of the main body 21 and the holding of the main body 21.

(1-18) The liquid pouring port 42 is exposed when the main body 21 is disposed at the open position. Therefore, by displacing the main body 21 from the closed position to the open position along the front-rear direction Y, the liquid pouring port 42 mounted on the main body 21 can be exposed. In this way, by displacing the main body 21 from the closed position to the open position along the front-rear direction Y, the liquid can be poured into the liquid pouring port 42, and the workability can be improved.

(1-19) The waste liquid mounting portion 45 is mounted on the main body 21 and is exposed when the main body 21 is disposed at the open position. Therefore, by displacing the main body 21 from the closed position to the open position along the front-rear direction Y, the waste liquid mounting portion 45 mounted on the main body 21 can be exposed. In this way, by displacing the main body 21 from the closed position to the open position along the front-rear direction Y, the waste liquid accommodating body 46 can be attached to and detached from the waste liquid mounting portion 45, and the workability regarding the waste liquid mounting portion 45 can be improved.

(1-20) At least a part of the transport path 49 is exposed when the main body 21 is disposed at the second open position. Therefore, by displacing the main body 21 from the closed position to the second open position along the front-rear direction Y, at least a part of the transport path 49 mounted on the main body 21 can be exposed. In this way, by displacing the main body 21 from the closed position to the second open position along the front-rear direction Y, the medium can be removed in at least a part of the transport path 49, and workability can be improved.

Second Embodiment

Next, a second embodiment will be described. In the following description, overlapping descriptions will be omitted or simplified for the same configurations as the embodiments already described, and configurations different from the embodiments already described will be mainly described.

First Separation Process

Figure 16:
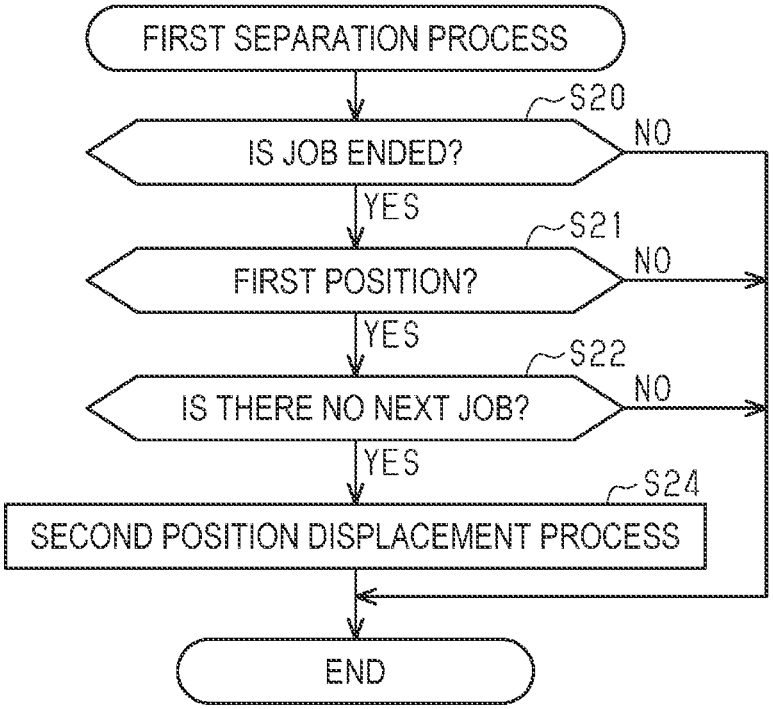
FIG. 16 is a flowchart showing a first separation process of a second embodiment.

As shown in FIG. 16, in the first separation process, when the control portion 23 determines that there is a next job in step S22, the control portion 23 ends the first separation process without executing step S24. When the control portion 23 determines that there is no next job, the process proceeds to step S24. In this way, the control portion 23 displaces the displacement portion 86 to the second position P12 when there is no next job after the job of performing recording on the medium is ended.

Effects of Second Embodiment

The effects of the second embodiment will be described.

(2-1) The control portion 23 displaces the displacement portion 86 to the second position P12 when there is no next job after the job of performing recording on the medium is ended. According to this configuration, by displacing the feeding roller 63 to the separation position at an appropriate timing, it is possible to suppress bleed marks caused by the feeding roller 63.

Third Embodiment

Next, a third embodiment will be described.

Pressed Portion 88 and Pressing Portion 89

Figure 17:
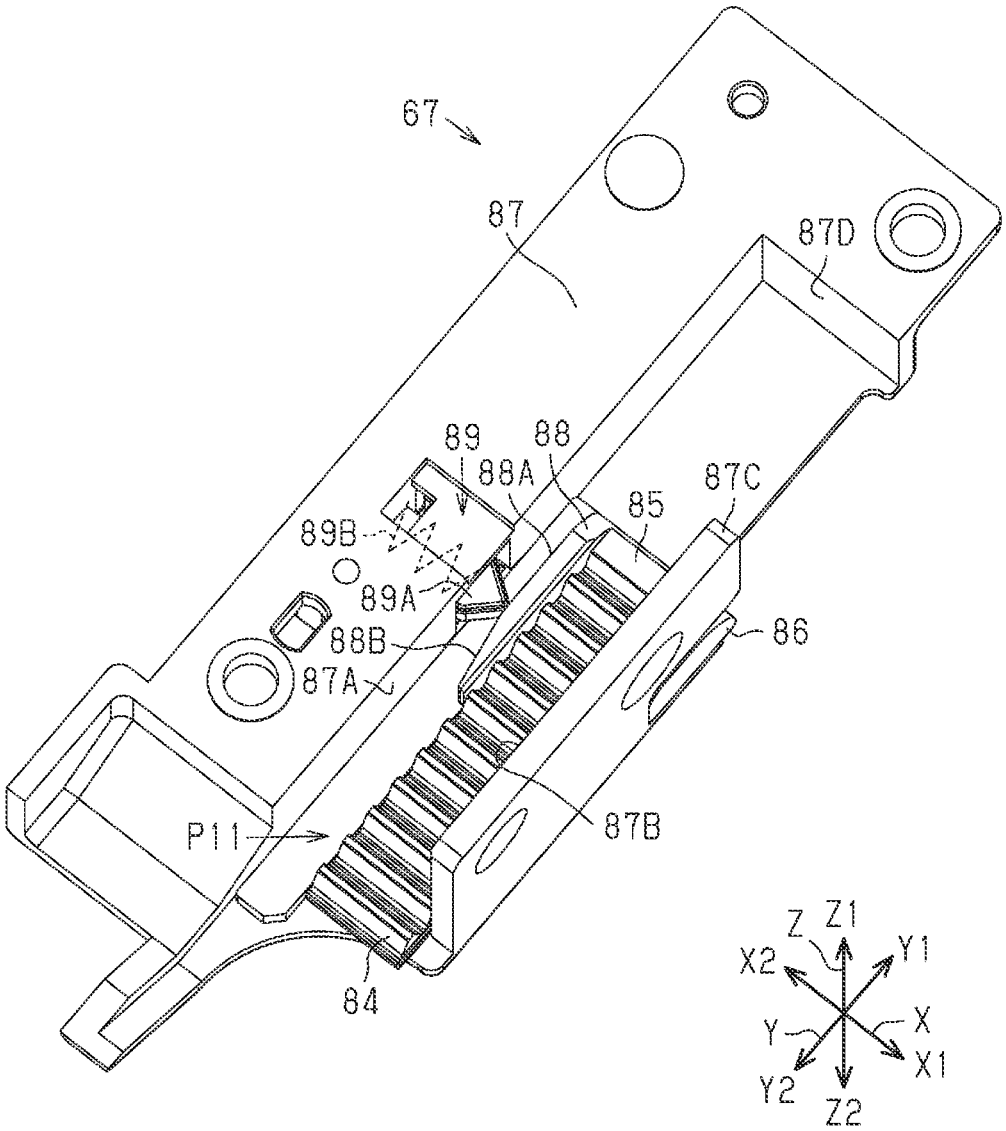
FIG. 17 is a perspective view showing a medium feeding apparatus according to a third embodiment.
Figure 18:
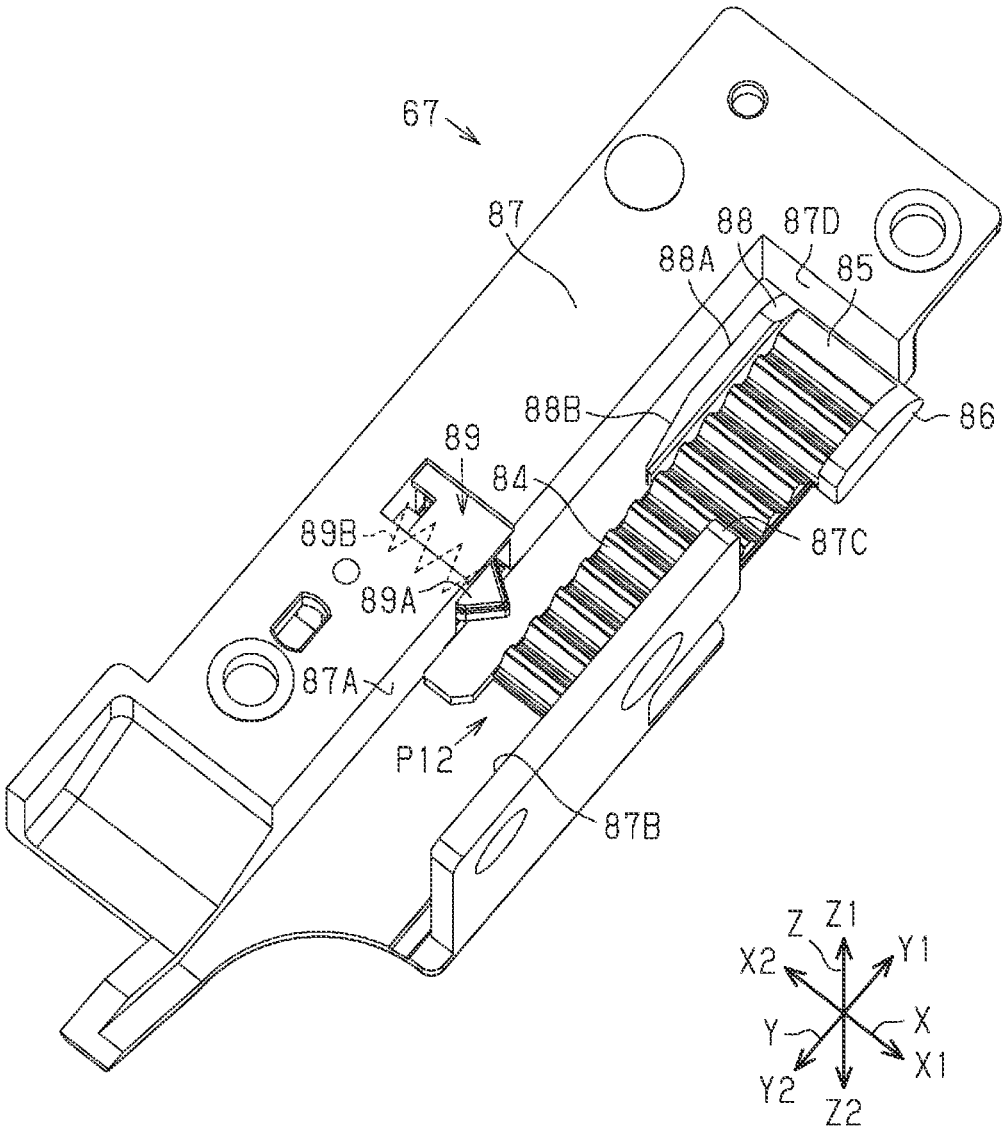
FIG. 18 is a perspective view showing the medium feeding apparatus according to the third embodiment.

As shown in FIGS. 17 and 18, in the third embodiment, the displacement unit 67 includes a pressed portion 88. The pressed portion 88 is configured integrally with the rack 84. The pressed portion 88 is provided on the rear side Y2 of the rack 84 and on the second width direction X2 side of the rack 84. The pressed portion 88 may be a protrusion that protrudes to the upper side Z1.

The pressed portion 88 includes a first surface 88A and a second surface 88B. The first surface 88A is a surface that is continuous with the second surface 88B in the front-rear direction Y. The first surface 88A is located on the rear side Y2 with respect to the second surface 88B. The first surface 88A is a surface that is perpendicular to the width direction X. The second surface 88B is a surface that is inclined with respect to the width direction X. Specifically, the second surface 88B is a surface that is inclined toward the first width direction X1 as it advances to the front side Y1.

The displacement unit 67 includes a pressing portion 89. The pressing portion 89 is accommodated in the unit housing 87. The pressing portion 89 is provided on the second width direction X2 side with respect to the rack 84. When the rack 84 is disposed at the first position P11, the pressing portion 89 can press the pressed portion 88 in the first width direction X1.

The pressing portion 89 includes a protruding portion 89A and a biasing portion 89B. The protruding portion 89A is accommodated in the unit housing 87. The protruding portion 89A protrudes from the first guide portion 87A in the first width direction X1. The biasing portion 89B is accommodated in the unit housing 87. The biasing portion 89B biases the protruding portion 89A in the first width direction X1.

As shown in FIG. 17, when the rack 84 is disposed at the first position P11, the pressed portion 88 is located on the first width direction X1 side with respect to the pressing portion 89. That is, the pressed portion 88 is disposed at a position facing the pressing portion 89 in the width direction X. The pressed portion 88 comes into contact with the pressing portion 89 in the width direction X. Specifically, the protruding portion 89A comes into contact with the first surface 88A in the width direction X.

In this case, the pressed portion 88 displaces the protruding portion 89A in the second width direction X2 against the biasing force of the biasing portion 89B. That is, the pressing portion 89 presses the pressed portion 88 in the first width direction X1 by using the biasing force of the biasing portion 89B. Thereby, the rack 84 is pressed against the second guide portion 87B when the rack 84 is disposed at the first position P11.

In addition, in a state in which the rack 84 is disposed at the first position P11, the coefficient of friction between the rack 84 and the unit housing 87 and the biasing force by the biasing portion 89B are determined so that the cumulative load from the driving portion 65 to the rack 84 is smaller than the reverse rotation power by the driving portion 65. Thereby, when the rack 84 is disposed at the first position P11 in a state in which the feeding roller unit 61 is mounted on the drive shaft 62, in response to the reverse rotation power from the driving portion 65, the rack 84 moves to the rear side Y2 against the pressure from the pressing portion 89. In this way, when the rack 84 moves to the rear side Y2, the protruding portion 89A changes from a state in which it comes into contact with the first surface 88A in the width direction X to a state in which it comes into contact with the second surface 88B in the width direction X, and then is brought into a state in which it does not come into contact with the pressed portion 88.

As shown in FIG. 18, when the rack 84 is disposed at the second position P12, the pressed portion 88 is located on the rear side Y2 with respect to the first width direction X1 of the pressing portion 89. That is, the pressed portion 88 is disposed at a position that does not face the pressing portion 89 in the width direction X. The pressed portion 88 does not come into contact with the pressing portion 89. In this case, the pressing portion 89 does not press the pressed portion 88. Thereby, the rack 84 is not pressed against the second guide portion 87B when the rack 84 is disposed at the second position P12.

On the other hand, a removal operation may be performed in a state in which the rack 84 is disposed at the first position P11. The removal operation is an operation in which the feeding roller unit 61 is removed from the drive shaft 62. Even when a rotational force smaller than the cumulative load from the driving portion 65 to the rack 84 is applied to the drive shaft 62 according to the removal operation, the rack 84 is pressed against the second guide portion 87B. Therefore, the drive shaft 62 does not rotate and the rack 84 does not move in the front-rear direction Y from the first position P11.

Further, a mounting operation may be performed in a state in which the rack 84 is disposed at the first position P11. The mounting operation is an operation in which the feeding roller unit 61 is mounted on the drive shaft 62. Even when a rotational force smaller than the cumulative load from the driving portion 65 to the rack 84 is applied to the drive shaft 62 according to the mounting operation, the rack 84 is pressed against the second guide portion 87B. Therefore, the drive shaft 62 does not rotate and the rack 84 does not move in the front-rear direction Y from the first position P11.

Structure of Arm Portion 64

Figure 19:
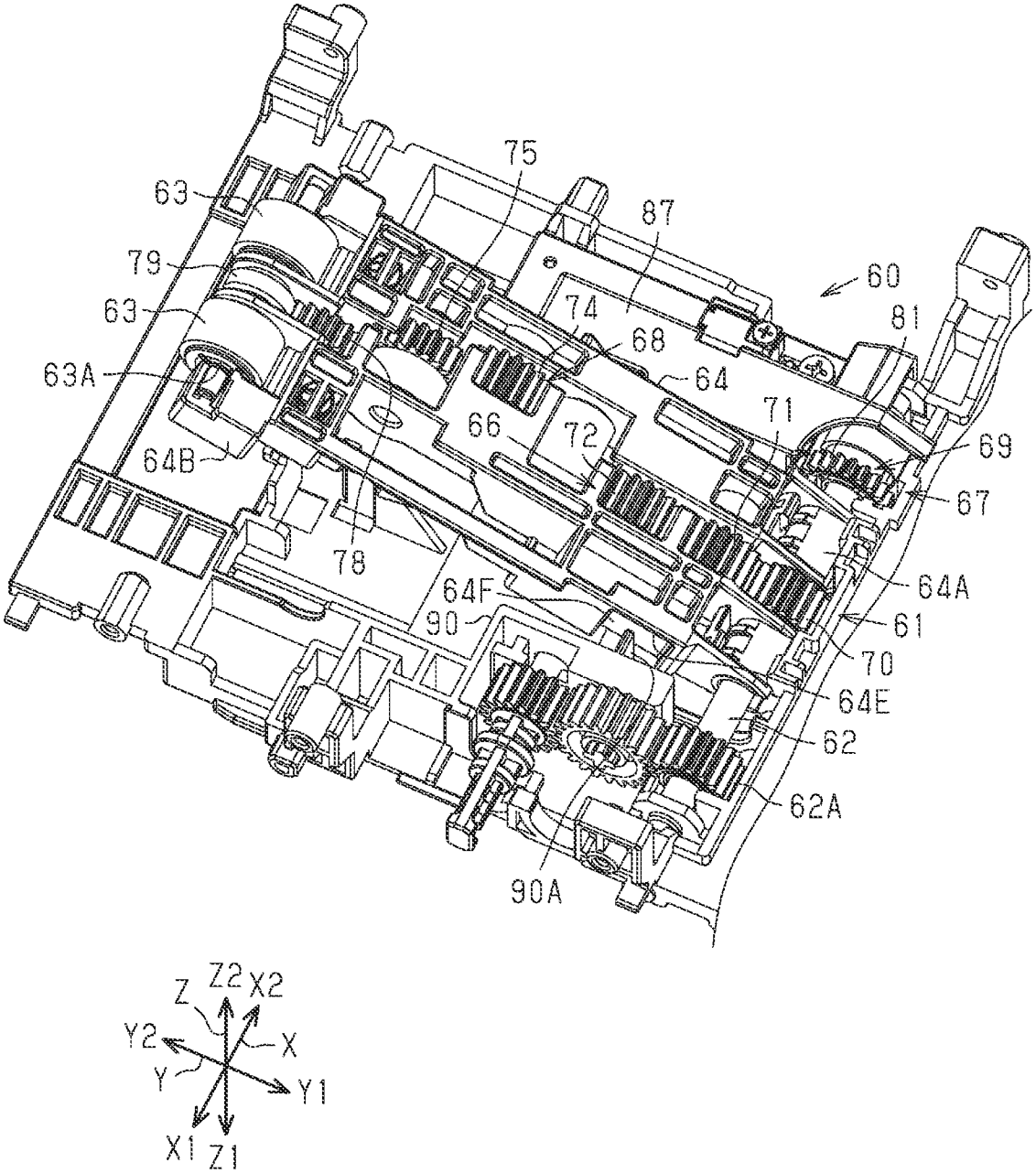
FIG. 19 is a perspective view showing the medium feeding apparatus according to the third embodiment.

As shown in FIG. 19, the arm portion 64 includes a recess portion 64E. The recess portion 64E is provided on the first width direction X1 side of the arm portion 64. The recess portion 64E is displaced depending on the position of the feeding roller unit 61. The recess portion 64E has a recessed shape in the second width direction X2. The recess portion 64E forms an accommodation space 64F.

The medium feeding apparatus 60 includes a frame 90. The frame 90 is configured separately from the arm portion 64. The frame 90 includes a projection portion 90A. The projection portion 90A extends toward the recess portion 64E. The projection portion 90A is not displaced depending on the position of the feeding roller unit 61. The projection portion 90A can be accommodated in the accommodation space 64F. In particular, the projection portion 90A is accommodated within the accommodation space 64F within the operating range of the feeding roller unit 61. In this way, by handling the feeding roller unit 61 so that the projection portion 90A is accommodated in the accommodation space 64F, the ease of attaching and detaching the feeding roller unit 61 can be improved.

In particular, when the medium feeding apparatus 60 is of the first type, the arm portion 64 is provided with the recess portion 64E, and the frame 90 is provided with the projection portion 90A. When the medium feeding apparatus 60 is of the second type, the arm portion 64 is not provided with the recess portion 64E, and the frame 90 is not provided with the projection portion 90A.

Therefore, when the first type of feeding roller unit 61 is attached to the first type of frame 90, the projection portion 90A is accommodated in the recess portion 64E. On the other hand, when the second type of feeding roller unit 61 is attached to the first type of frame 90, the recess portion 64E is not provided, and thus, the projection portion 90A comes into contact with the arm portion 64. Thereby, the second type of feeding roller unit 61 is not attached to the first type of frame 90. With such a configuration, it is possible to prevent feeding roller units 61 of different types from being attached to the frame 90. The arm portion 64 may include a projection portion and the frame 90 may include a recess portion.

Effects of Third Embodiment

The effects of the third embodiment will be described.

(3-1) The medium feeding apparatus 60 includes the pressing portion 89 that presses the rack 84 against the second guide portion 87B when the rack 84 is disposed at the first position P11. According to this configuration, even when a rotational force is applied to the drive shaft 62 according to the operation of attaching and detaching the feeding roller unit 61 to and from the drive shaft 62, the rack 84 is pressed by the second guide portion 87B. Therefore, the rack 84 does not move in the front-rear direction Y from the first position P11. Thereby, the ease of mounting the feeding roller unit 61 can be improved. Therefore, user convenience can be improved.

Modification Example

The present embodiment can be modified and implemented as follows. The present embodiment and the following modification example can be implemented in combination with each other unless there is a technical contradiction.

The medium feeding apparatus 60 is not limited to the configuration in which three gears 81 to 83 are used between the drive shaft 62 and the rack 84, and for example, one gear may be used, or for example, five gears may be used. When the displacement portion 86 is displaced from the second position P12 to the first position P11 based on the forward rotation power, and the displacement portion 86 is displaced from the first position P11 to the second position P12 based on the reverse rotation power, the medium feeding apparatus 60 may include, for example, two or four gears between the drive shaft 62 and the rack 84.

The medium feeding apparatus 60 is not limited to the configuration in which the displacement portion 86 supports the arm portion 64 from the lower side Z2, and may have a configuration in which the displacement portion 86 supports the arm portion 64 by pressing it from the width direction X or the front-rear direction Y, for example.

The medium feeding apparatus 60 is not limited to the configuration in which the displacement portion 86 is displaced using the rack 84, and may have a configuration in which the displacement portion 86 is displaced using a cam, for example.

The displacement portion 86 may be in contact with the arm portion 64 in a case in which the feeding roller 63 is separated from the medium when the displacement portion 86 is disposed at the first position P11.

In the first embodiment, the predetermined time may be the time until the power saving mode is entered after the job is ended. The setting of the predetermined time may be changeable according to the instruction of the user.

The control portion 23 may determine whether or not to execute the first separation process in accordance with a condition such as the type of medium, for example.

The recording apparatus 11 may include a detection portion that detects the medium placed on the medium placement portion 54. In this case, when the control portion 23 determines that a medium is not placed on the medium placement portion 54 based on a result of detection performed by the detection portion, the control portion 23 may continue to dispose the displacement portion 86 at the first position P11 without displacing the displacement portion 86 from the first position P11 to the second position P12. When the control portion 23 determines that a medium is placed on the medium placement portion 54 based on a result of detection performed by the detection portion, the control portion 23 may displace the displacement portion 86 from the first position P11 to the second position P12.

The medium feeding apparatus 60 may include a detection portion that detects that the displacement portion 86 is at the first position P11. The medium feeding apparatus 60 may include a detection portion that detects that the displacement portion 86 is at the second position P12, and in this case, may not include the second restricting portion 87D. Based on a result of detection performed by the detection portion, when the displacement portion 86 is displaced from the first position P11 to the second position P12, the control portion 23 may stop the reverse rotation drive by the driving portion 65.

The torque limiter 80 is not limited to rotating in the same rotation direction as the feeding roller 63 based on the forward rotation power, and may rotate in the rotation direction opposite to the feeding roller 63 based on the forward rotation power. Thereby, it is possible to suppress the transport force of the feeding roller 63 and suppress double feeding of the medium.

The power transmission portion 66 may include a common power transmission portion common to a first power transmission path and a second power transmission path.

The control portion 23 is not limited to continuously executing the contact process and the feeding process, and may, for example, stop the driving portion 65 between the contact process and the feeding process.

When the displacement portion 86 is disposed at the first position P11, the control portion 23 may cause the display portion 35 to display an image prompting an attachment/detachment instruction when a predetermined time has elapsed after the job is ended. The control portion 23 may cause the display portion 35 to display an image prompting the attachment/detachment instruction, and then displace the displacement portion 86 from the first position P11 to the second position P12 according to the operation of the operation portion 34.

The attachment and detachment of the arm portion 64 may be performed when it is determined that the arm portion 64 needs to be replaced, for example, based on at least any one of the number of media fed and the number of feeding failures, in addition to an instruction from the user.

In the above embodiment, a serial printer is employed as the recording apparatus 11, but the present disclosure is not limited thereto. For example, a lateral printer may be employed as the recording apparatus 11, or a line printer may be employed. The lateral printer is a printer in which the carriage is movable in two directions, such as a main scanning direction and a sub-scanning direction. The line printer is a printer that includes a plurality of nozzles arranged in the width direction X at a constant pitch and is capable of simultaneously ejecting a liquid across the width of the medium.

The medium is not limited to paper. The medium may be a resin film or sheet, a composite film of resin and metal, a laminate film, a woven fabric, a non-woven fabric, a metal foil, a metal film, a ceramic sheet, clothing, or the like. Moreover, the medium may be fed out from a roll body.

Any liquid can be selected as long as it can record on a medium by adhering to the medium. For example, ink includes those in which particles of functional materials made of solid substances such as pigments and metal particles are dissolved, dispersed, or mixed in a solvent, and includes various compositions such as water-based ink, oil-based ink, gel ink, and hot melt ink.

The recording apparatus 11 is not limited to an ink jet printer, and may be a dot impact printer. The recording method for the recording apparatus 11 may be a laser method instead of an ink jet method.

The expression "at least any one" used in the present specification means one or more of desired options. As an example, the expression "at least any one" used in the present specification means only one option or both of two options when the number of options is two. In another example, the expression "at least any one" used in the present specification means only one option or a combination of any two or more options when the number of options is three or more.

Additional Notes

Hereinafter, the technical ideas and the operational effects understood from the above-described embodiment and modification example will be described.

(A) A medium feeding apparatus includes: a feeding roller configured to feed a medium placed on a medium placement portion; a driving portion that drives the feeding roller; an arm portion that supports the feeding roller and is configured to rotate about a drive shaft; and a displacement portion that is configured to come into contact with the arm portion and rotates the arm portion by using forward rotation power from the driving portion, in which the feeding roller feeds the medium placed on the medium placement portion by using forward rotation power from the driving portion, the arm portion displaces the feeding roller between a contact position and a separation position, the contact position is a position where the feeding roller contacts the medium placed on the medium placement portion, the separation position is a position where the feeding roller is separated from the medium placed on the medium placement portion, and the displacement portion rotates the arm portion to displace the feeding roller from the separation position to the contact position by using forward rotation power from the driving portion, and rotates the arm portion to displace the feeding roller from the contact position to the separation position by using reverse rotation power from the driving portion.

According to this configuration, the driving of the feeding roller and the displacement portion that displaces the arm portion that supports the feeding roller can be implemented using power from the common driving portion. Therefore, it is possible to suppress bleed marks caused by the feeding roller, and it is also possible to suppress the increase in size of the apparatus.

(B) In the medium feeding apparatus according to (A), the displacement portion may be configured to be displaced between a first position and a second position, the first position may be a position where the feeding roller is displaced to the contact position due to non-contact with the arm portion, and the second position may be a position where the feeding roller is displaced to the separation position due to contact with the arm portion.

According to this configuration, with a simple configuration that switches between non-contact and contact between the displacement portion and the arm portion, the feeding roller can be displaced to the contact position and the separation position by using the power from the common driving portion. Therefore, it is possible to suppress bleed marks caused by the feeding roller, and it is also possible to suppress the increase in size of the apparatus.

(C) In the medium feeding apparatus according to (B), the displacement portion may support the arm portion from below in a vertical direction at the second position.

According to this configuration, with a simple configuration that switches whether or not to support the displacement portion and the arm portion from the lower side, the feeding roller can be displaced to the contact position and the separation position by using the power from the common driving portion. Therefore, it is possible to suppress bleed marks caused by the feeding roller, and it is also possible to suppress the increase in size of the apparatus.

(D) The medium feeding apparatus according to any one of (A) to (C) may further include a rack that is movable in parallel, and the displacement portion may be provided on the rack.

According to this configuration, with a simple configuration in which the displacement portion is provided in the rack that is movable in parallel, the feeding roller can be displaced to the contact position and the separation position by using the power from the common driving portion. Therefore, it is possible to suppress bleed marks caused by the feeding roller, and it is also possible to suppress the increase in size of the apparatus.

(E) In the medium feeding apparatus according to any one of (A) to (D), the displacement portion may be configured to be displaced between a first position and a second position, the first position may be a position where the feeding roller is displaced to the contact position, the second position may be a position where the feeding roller is displaced to the separation position, the rack may be movable in a first movement direction toward the feeding roller and in a second movement direction which is a direction opposite to the first movement direction, and when the displacement portion is disposed at the first position, the rack may be located in the first movement direction with respect to the drive shaft, and may not protrude in the second movement direction from the drive shaft.

According to this configuration, the rack can be positioned in the first movement direction toward the feeding roller with respect to the drive shaft. Thereby, even when the arm portion and the rack are at the farthest position, it is possible to suppress the displacement of the arm portion from interfering with the drive shaft.

(F) The medium feeding apparatus according to any one of (A) to (E) may further include a power transmission portion configured to transmit power from the driving portion to the feeding roller and the displacement portion, and the power transmission portion may include a one-way clutch that transmits forward rotation power from the driving portion to the feeding roller, but that does not transmit reverse rotation power from the driving portion to the feeding roller.

According to this configuration, the displacement portion can displace the feeding roller to the separation position by using the reverse rotation power from the driving portion without the one-way clutch transmitting the reverse rotation power to the feeding roller. Thereby, the feeding roller can be displaced to the separation position without rotating the feeding roller. Therefore, it is possible to improve the alignment of the medium in contact with the feeding roller.

(G) The medium feeding apparatus according to any one of (A) to (F) may further include: a power transmission portion configured to transmit power from the driving portion to the feeding roller and the displacement portion; and a restricting portion that restricts displacement of the displacement portion, the displacement portion may be configured to be displaced between a first position and a second position, the first position may be a position where the feeding roller is displaced to the contact position, the second position may be a position where the feeding roller is displaced to the separation position, the restricting portion may restrict displacement of the displacement portion at the second position when the displacement portion is displaced from the first position to the second position, and restrict displacement of the displacement portion at the first position when the displacement portion is displaced from the second position to the first position, the power transmission portion may include a first power transmission portion that transmits power from the driving portion to the feeding roller, and a second power transmission portion that transmits power from the driving portion to the displacement portion, the second power transmission portion may include a torque limiter that blocks transmission of power at a predetermined load, and the torque limiter may block transmission of power to the displacement portion when the displacement of the displacement portion is restricted by the restricting portion at the second position, and block the transmission of power to the displacement portion when the displacement of the displacement portion is restricted by the restricting portion at the first position.

According to this configuration, when the displacement of the displacement portion is restricted by the restricting portion at the first position and the second position, a load equal to or greater than a predetermined load is applied to the torque limiter in the second power transmission portion, and thereby the torque limiter blocks the transmission of power to the displacement portion. In this way, by providing the torque limiter, it is possible to suppress the load on the driving portion when driving the feeding roller. In particular, by providing the torque limiter in the second power transmission portion different from the power transmission path to the feeding roller, the torque limiter can be provided further upstream. Therefore, it is possible to suppress the load on the driving portion when driving the feeding roller. Furthermore, the displacement portion can be accurately displaced to the first position and the second position without providing a detection portion that detects displacement of the displacement portion to the first position and the second position. Therefore, it is possible to improve the alignment of the medium in contact with the feeding roller.

(H) In the medium feeding apparatus according to (G), the torque limiter may be provided coaxially with the drive shaft.

According to this configuration, the weight of the arm portion can be reduced as compared with a configuration in which the torque limiter is provided in the arm portion. Accordingly, it is possible to suppress the influence on the transport force of the feeding roller supported by the arm portion. Moreover, the increase in size of the apparatus can be suppressed as compared with a configuration in which the torque limiter is provided upstream of the drive shaft.

(I) In the medium feeding apparatus according to any one of (A) to (H), the arm portion may swingably support the feeding roller.

According to this configuration, vibration of the feeding roller can be suppressed.

(J) In the medium feeding apparatus according to any one of (A) to (I), the arm portion may be attachable to and detachable from the drive shaft.

According to this configuration, by removing the arm portion from the drive shaft, the feeding roller can be easily replaced.

(K) The medium feeding apparatus according to any one of (A) to (I) may include an arm retraction portion that retracts the arm portion to a retracted position when pulling out the medium placement portion in a pull-out direction.

According to this configuration, it is possible to suppress the medium placement portion from interfering with the arm portion when the medium placement portion is pulled out.

(L) A recording apparatus includes the medium feeding apparatus according to any one of (A) to (K), and a recording portion that performs recording on the medium fed by the feeding roller. According to this configuration, the same effects as in (A) can be achieved.

(M) The recording apparatus according to (L) may further include: a reversing portion that reverses the medium fed by the medium feeding apparatus, and the recording portion may be configured to perform recording on photo paper that is configured to be double-sided printed as a medium, and may be configured to perform recording after the medium is reversed by the reversing portion.

According to this configuration, it is possible to suppress bleed marks caused by the feeding roller on photo paper that can be double-sided printed. Thereby, even more special effects can be achieved.

(N) The recording apparatus according to (L) or (M) may further include a control portion, the displacement portion may be configured to be displaced between a first position and a second position, the first position may be a position where the feeding roller is displaced to the contact position, the second position may be a position where the feeding roller is displaced to the separation position, and the control portion may displace the displacement portion to the second position in at least any one of when there is no next job after a job of performing recording on a medium is ended, when there is no next job for a predetermined time after a job of performing recording on a medium is ended, and when power is turned off.

According to this configuration, the feeding roller can be displaced to the separation position in at least any one of when there is no next job after the end of a job and when the power is turned off. Thereby, by displacing the feeding roller to the separation position at an appropriate timing, it is possible to suppress bleed marks caused by the feeding roller.

(O) The recording apparatus according to any one of (L) to (N) may further include: a control portion; and a medium detection portion that detects a tip of the medium fed by the feeding roller, the displacement portion may be configured to be displaced between a first position and a second position, the first position may be a position where the feeding roller is displaced to the contact position, the second position may be a position where the feeding roller is displaced to the separation position, when the displacement portion is at the first position, the control portion may determine that a feeding error occurs when the tip of the medium is not detected by the medium detection portion even when a first time elapsed after driving of the driving portion was started to feed the medium, and when the displacement portion is at the second position, the control portion may determine that the feeding error occurs when the tip of the medium is not detected by the medium detection portion even when a second time, which is longer than the first time, elapsed after driving of the driving portion was started to feed the medium.

According to this configuration, when the medium is fed by the feeding roller, the feeding roller comes into contact with the medium after a time during which the displacement portion is displaced from the second position to the first position when the displacement portion is at the second position rather than when the displacement portion is at the first position. Therefore, when the medium is fed by the feeding roller, the accuracy of determining a feeding error can be increased by lengthening the time that is the reference for determining a feeding error when the displacement portion is at the second position rather than when the displacement portion is at the first position.

(P) A recording apparatus includes: the medium feeding apparatus according to (C); a recording portion that performs recording on the medium fed by the feeding roller; and a control portion, the arm portion is attachable to and detachable from the drive shaft, and when the displacement portion is at the second position, the control portion displaces the displacement portion from the second position to the first position when the arm portion is attached to and detached from the drive shaft.

According to this configuration, by displacing the displacement portion from the second position to the first position, it is possible to suppress interference between the displacement portion and the arm portion. Thereby, the arm portion can be easily attached to and detached from the drive shaft. Therefore, user convenience can be improved.

(Q) There is provided a control method for the recording apparatus according to (L) or (M), the displacement portion being configured to be displaced between a first position and a second position, the first position being a position where the feeding roller is displaced to the contact position, and the second position being a position where the feeding roller is displaced to the separation position, the control method including: displacing the displacement portion to the second position in at least any one of when there is no next job after a job of performing recording on a medium is ended, when there is no next job for a predetermined time after a job of performing recording on a medium is ended, and when power is turned off. According to this configuration, the same effects as in (N) can be achieved.

(R) In the control method for the recording apparatus according to (Q), the recording apparatus may include a medium detection portion that detects a tip of the medium fed by the feeding roller, and the control method may further include: determining that, when the displacement portion is at the first position, a feeding error occurs when the tip of the medium is not detected by the medium detection portion even when a first time elapsed after driving of the driving portion was started to feed the medium; and determining that, when the displacement portion is at the second position, the feeding error occurs when the tip of the medium is not detected by the medium detection portion even when a second time, which is longer than the first time, elapsed after driving of the driving portion was started to feed the medium. According to this configuration, the same effects as in (O) can be achieved.

(S) A control method for a recording apparatus includes the medium feeding apparatus according to (C) and a recording portion that performs recording on the medium fed by the feeding roller, the arm portion is attachable to and detachable from the drive shaft, and the control method includes displacing, when the displacement portion is at the second position, the displacement portion from the second position to the first position when the arm portion is attached to and detached from the drive shaft. According to this configuration, the same effects as in (P) can be achieved.

What is claimed is:

1. A medium feeding apparatus comprising:

a feeding roller configured to feed a medium placed on a medium placement portion;

a driving portion that drives the feeding roller;

an arm portion that supports the feeding roller and is configured to rotate about a drive shaft; and a displacement portion that is configured to come into contact with the arm portion and rotates the arm portion by using forward rotation power from the driving portion, wherein the feeding roller feeds the medium placed on the medium placement portion by using forward rotation power from the driving portion, the arm portion displaces the feeding roller between a contact position and a separation position, the contact position is a position where the feeding roller contacts the placed medium, the separation position is a position where the feeding roller is separated from the placed medium, and the displacement portion rotates the arm portion to displace the feeding roller from the separation position to the contact position by using forward rotation power from the driving portion, and rotates the arm portion to displace the feeding roller from the contact position to the separation position by using reverse rotation power from the driving portion.

2. The medium feeding apparatus according to claim 1, wherein the displacement portion is configured to be displaced between a first position and a second position, the first position is a position where the feeding roller is displaced to the contact position due to non-contact with the arm portion, and the second position is a position where the feeding roller is displaced to the separation position due to contact with the arm portion.

3. The medium feeding apparatus according to claim 2, wherein the displacement portion supports the arm portion from below in a vertical direction at the second position.

4. A recording apparatus comprising:

the medium feeding apparatus according to claim 3;

a recording portion that performs recording on the medium fed by the feeding roller; and a control portion, wherein the arm portion is attachable to and detachable from the drive shaft, and when the displacement portion is at the second position, the control portion displaces the displacement portion from the second position to the first position when the arm portion is attached to and detached from the drive shaft.

5. A control method for a recording apparatus including the medium feeding apparatus according to claim 3, and a recording portion that performs recording on the medium fed by the feeding roller, the arm portion being attachable to and detachable from the drive shaft, the control method comprising:

displacing, when the displacement portion is at the second position, the displacement portion from the second position to the first position when the arm portion is attached to and detached from the drive shaft.

6. The medium feeding apparatus according to claim 1, further comprising:

a rack that is movable in parallel, wherein the displacement portion is provided on the rack.

7. The medium feeding apparatus according to claim 6, wherein the displacement portion is configured to be displaced between a first position and a second position, the first position is a position where the feeding roller is displaced to the contact position, the second position is a position where the feeding roller is displaced to the separation position, the rack is movable in a first movement direction toward the feeding roller and in a second movement direction which is a direction opposite to the first movement direction, and when the displacement portion is disposed at the first position, the rack is located in the first movement direction with respect to the drive shaft, and does not protrude in the second movement direction from the drive shaft.

8. The medium feeding apparatus according to claim 1, further comprising:

a power transmission portion configured to transmit power from the driving portion to the feeding roller and the displacement portion, wherein the power transmission portion includes a one-way clutch that transmits forward rotation power from the driving portion to the feeding roller, but that does not transmit reverse rotation power from the driving portion to the feeding roller.

9. The medium feeding apparatus according to claim 1, further comprising:

a power transmission portion configured to transmit power from the driving portion to the feeding roller and the displacement portion; and a restricting portion that restricts displacement of the displacement portion, wherein the displacement portion is configured to be displaced between a first position and a second position, the first position is a position where the feeding roller is displaced to the contact position, the second position is a position where the feeding roller is displaced to the separation position, the restricting portion restricts displacement of the displacement portion at the second position when the displacement portion is displaced from the first position to the second position, and restricts displacement of the displacement portion at the first position when the displacement portion is displaced from the second position to the first position, the power transmission portion includes a first power transmission portion that transmits power from the driving portion to the feeding roller, and a second power transmission portion that transmits power from the driving portion to the displacement portion, the second power transmission portion includes a torque limiter that blocks transmission of power at a predetermined load, and the torque limiter blocks transmission of power to the displacement portion when the displacement of the displacement portion is restricted by the restricting portion at the second position, and blocks the transmission of power to the displacement portion when the displacement of the displacement portion is restricted by the restricting portion at the first position.

10. The medium feeding apparatus according to claim 9, wherein the torque limiter is provided coaxially with the drive shaft.

11. The medium feeding apparatus according to claim 1, wherein the arm portion swingably supports the feeding roller.

12. The medium feeding apparatus according to claim 1, wherein the arm portion is attachable to and detachable from the drive shaft.

13. The medium feeding apparatus according to claim 1, further comprising:

an arm retraction portion that retracts the arm portion to a retracted position when pulling out the medium placement portion in a pull-out direction.

14. A recording apparatus comprising:

the medium feeding apparatus according to claim 1; and a recording portion that performs recording on the medium fed by the feeding roller.

15. The recording apparatus according to claim 14, further comprising:

a reversing portion that reverses the medium fed by the medium feeding apparatus, wherein the recording portion is configured to perform recording on photo paper that is configured to be double-sided printed as a medium, and is configured to perform recording after the medium is reversed by the reversing portion.

16. The recording apparatus according to claim 14, further comprising:

a control portion, wherein the displacement portion is configured to be displaced between a first position and a second position, the first position is a position where the feeding roller is displaced to the contact position, the second position is a position where the feeding roller is displaced to the separation position, and the control portion displaces the displacement portion to the second position in at least any one of when there is no next job after a job of performing recording on a medium is ended, when there is no next job for a predetermined time after a job of performing recording on a medium is ended, and when power is turned off.

17. The recording apparatus according to claim 14, further comprising:

a control portion; and a medium detection portion that detects a tip of the medium fed by the feeding roller, wherein the displacement portion is configured to be displaced between a first position and a second position, the first position is a position where the feeding roller is displaced to the contact position, the second position is a position where the feeding roller is displaced to the separation position, when the displacement portion is at the first position, the control portion determines that a feeding error occurs when the tip of the medium is not detected by the medium detection portion even when a first time elapsed after driving of the driving portion was started to feed the medium, and when the displacement portion is at the second position, the control portion determines that the feeding error occurs when the tip of the medium is not detected by the medium detection portion even when a second time, which is longer than the first time, elapsed after driving of the driving portion was started to feed the medium.

18. A control method for the recording apparatus according to claim 14, the displacement portion being configured to be displaced between a first position and a second position, the first position being a position where the feeding roller is displaced to the contact position, and the second position being a position where the feeding roller is displaced to the separation position, the control method comprising:

displacing the displacement portion to the second position in at least any one of when there is no next job after a job of performing recording on a medium is ended, when there is no next job for a predetermined time after a job of performing recording on a medium is ended, and when power is turned off.

19. The control method for the recording apparatus according to claim 18, wherein the recording apparatus includes a medium detection portion that detects a tip of the medium fed by the feeding roller, and the control method further comprises:

determining that, when the displacement portion is at the first position, a feeding error occurs when the tip of the medium is not detected by the medium detection portion even when a first time elapsed after driving of the driving portion was started to feed the medium; and determining that, when the displacement portion is at the second position, the feeding error occurs when the tip of the medium is not detected by the medium detection portion even when a second time, which is longer than the first time, elapsed after driving of the driving portion was started to feed the medium.

* * * * *